US011365658B2

(12) United States Patent
Ostromecki et al.

(10) Patent No.: US 11,365,658 B2
(45) Date of Patent: Jun. 21, 2022

(54) ACOUSTICALLY TUNED MUFFLER

(71) Applicant: Tenneco Automotive Operating Company Inc., Lake Forest, IL (US)

(72) Inventors: Gabriel Ostromecki, Ann Arbor, MI (US); Keith Bartu, Dexter, MI (US); Jeremy Popovich, Brooklyn, MI (US); Brett Herwat, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 771 days.

(21) Appl. No.: 16/119,011

(22) Filed: Aug. 31, 2018

(65) Prior Publication Data

US 2019/0107019 A1 Apr. 11, 2019

Related U.S. Application Data

(60) Provisional application No. 62/598,147, filed on Dec. 13, 2017, provisional application No. 62/568,421, filed on Oct. 5, 2017.

(51) Int. Cl.
*F01N 1/08* (2006.01)
*G10K 11/16* (2006.01)
(Continued)

(52) U.S. Cl.
CPC ..... *F01N 1/083* (2013.01); *F01N 1/003* (2013.01); *F01N 1/006* (2013.01); *F01N 1/02* (2013.01);
(Continued)

(58) Field of Classification Search
CPC ..... F01N 1/003; F01N 1/023; F01N 2470/14; F01N 2490/14; F01N 2210/04;
(Continued)

(56) References Cited

U.S. PATENT DOCUMENTS 1,280,386 A 10/1918 Buehner
1,512,961 A 10/1924 Weil
(Continued)

FOREIGN PATENT DOCUMENTS

CN 101413419 A 4/2009
CN 102230407 A 11/2011
(Continued)

OTHER PUBLICATIONS

International Search Report and Written Opinion regarding PCT/US2018/064897, dated Mar. 21, 2019, 10 pages.
(Continued)

*Primary Examiner* — Jeremy A Luks
(74) *Attorney, Agent, or Firm* — Harness, Dickey & Pierce, P.L.C.

(57) ABSTRACT

A muffler may include a shell, first and second baffles, an inlet pipe, first and second outlet pipes, and a communication pipe. The first and second baffles cooperate with the shell to define first, second and third chambers. The first inlet pipe may extend through the shell and may provide exhaust gas to at least one of the first and second chambers. Exhaust gas in the first chamber exits the muffler through the first outlet pipe. Exhaust gas in the second chamber exits the muffler through the second outlet pipe. The communication pipe may include first, second and third openings. The first opening is in communication with the first chamber. The second opening is in communication with the second chamber. The third opening is in communication with the third chamber. The first and second chambers may be in communication with the third chamber through the communication pipe.

11 Claims, 15 Drawing Sheets

(51) Int. Cl.
*F01N 1/02* (2006.01)
*F01N 1/00* (2006.01)
*G10K 11/172* (2006.01)

(52) U.S. Cl.
CPC ..... *F01N 1/023* (2013.01); *G10K 11/161* (2013.01); *G10K 11/172* (2013.01); *F01N 2210/04* (2013.01); *F01N 2470/14* (2013.01); *F01N 2470/18* (2013.01); *F01N 2490/10* (2013.01); *F01N 2490/15* (2013.01)

(58) Field of Classification Search
CPC .. F01N 2470/16; F01N 2490/08; F01N 1/083; G10K 11/161; G10K 11/172
USPC ..... 181/238, 239
See application file for complete search history.

(56) References Cited

U.S. PATENT DOCUMENTS 2,323,955 A 7/1943 Wilson
2,692,025 A 10/1954 Hamilton
2,940,249 A 6/1960 Gospodar
2,975,072 A 3/1961 Bryant
3,072,214 A 1/1963 Deremer
3,109,510 A 11/1963 Phelan
3,209,858 A 10/1965 Jettinghoff
3,209,860 A 10/1965 Lentz
3,209,862 A 10/1965 Young
3,337,939 A 8/1967 Parkinson
3,388,769 A 6/1968 Martoia
3,420,052 A 1/1969 Miller
3,512,607 A 5/1970 Hubbell, III
3,583,524 A 6/1971 Dubois
3,623,901 A 11/1971 Forstmann et al.
3,643,760 A 2/1972 Hubbell, III
3,709,320 A 1/1973 Hollerl et al.
3,768,987 A 10/1973 Forstmann et al.
3,794,139 A 2/1974 Hetherington et al.
3,827,529 A 8/1974 Frietzsche et al.
3,949,829 A 4/1976 Honda et al.
4,064,963 A 12/1977 Kaan et al.
4,209,076 A 6/1980 Franco et al.
4,359,865 A 11/1982 Nakao et al.
4,756,437 A 7/1988 Rossi-Mossuti
4,909,348 A 3/1990 Harwood et al.
5,052,513 A 10/1991 Yoshikawa et al.
5,168,132 A 12/1992 Beidl et al.
5,265,420 A 11/1993 Rutschmann
5,321,214 A 6/1994 Uegane et al.
5,403,557 A 4/1995 Harris
5,530,213 A 6/1996 Hartsock et al.
5,593,645 A 1/1997 Steenackers et al.
5,907,135 A 5/1999 Hayakawa et al.
6,173,808 B1 * 1/2001 Maeda ..... F01N 1/02 181/254
6,341,664 B1 1/2002 Gerber
6,598,581 B2 7/2003 Kempf
6,726,957 B2 4/2004 Niemiec
6,830,847 B2 12/2004 Ramaswami et al.
6,889,499 B2 5/2005 Bassani
6,912,843 B2 * 7/2005 Hufendiek ..... F01N 1/02 60/282
7,001,675 B2 2/2006 Chan
7,051,523 B2 5/2006 Kerchner
7,377,359 B2 5/2008 Hofmann et al.
7,506,723 B2 3/2009 Hoerr et al.
7,637,349 B2 12/2009 Harada
7,669,693 B2 3/2010 Yamaguchi et al.
7,789,195 B2 9/2010 Mabuchi et al.
7,874,401 B2 1/2011 Uhlemann et al.
7,942,239 B2 5/2011 Huff et al.
7,967,107 B2 6/2011 Han et al.
8,292,026 B2 10/2012 Tauschek et al.
8,402,756 B2 3/2013 Luce et al.
8,528,693 B1 * 9/2013 Park ..... F01N 1/083 181/268
8,557,397 B2 10/2013 Bullard et al.
8,628,861 B2 1/2014 Bullard et al.
8,684,131 B1 4/2014 Park et al.
8,800,713 B2 * 8/2014 Keesser ..... F01N 13/14 181/250
8,827,035 B2 9/2014 Ross et al.
9,010,486 B2 * 4/2015 Andre ..... F01N 13/1888 181/268
9,067,282 B2 6/2015 Sharp
9,095,932 B2 8/2015 Miller et al.
9,096,035 B2 8/2015 Sachdev et al.
9,109,482 B2 8/2015 Fritz et al.
9,121,320 B2 9/2015 Carr et al.
9,341,102 B2 5/2016 Ross et al.
9,393,759 B2 7/2016 Luo et al.
9,429,052 B2 8/2016 Horr
9,623,515 B2 4/2017 Breuer et al.
9,644,509 B2 * 5/2017 Huang ..... F01N 1/083
9,689,301 B2 6/2017 Carr et al.
9,862,058 B2 1/2018 Breuer et al.
9,970,340 B2 * 5/2018 Abram ..... F01N 1/023
10,465,587 B2 * 11/2019 Kruger ..... F01N 1/163
2005/0115764 A1 6/2005 Mabuchi et al.
2006/0162995 A1 7/2006 Schorn et al.
2006/0231330 A1 10/2006 Morales et al.
2007/0102236 A1 5/2007 Uhlemann et al.
2007/0227807 A1 10/2007 Meneely et al.
2008/0093161 A1 4/2008 Winkel et al.
2008/0093162 A1 4/2008 Marocco et al.
2008/0196969 A1 8/2008 Henke et al.
2009/0000862 A1 1/2009 Buell et al.
2009/0229913 A1 9/2009 Tonietto et al.
2009/0249603 A1 10/2009 Vargas
2011/0083924 A1 4/2011 Park
2011/0272209 A1 11/2011 Tauschek et al.
2013/0171471 A1 7/2013 Bullard et al.
2013/0206271 A1 8/2013 Wieser et al.
2013/0213734 A1 8/2013 Ahn et al.
2014/0027414 A1 1/2014 Lin et al.
2014/0144721 A1 5/2014 Park
2014/0151149 A1 6/2014 Ross et al.
2015/0008068 A1 1/2015 Hamashima et al.
2015/0354421 A1 12/2015 Horr
2016/0340786 A1 11/2016 Mukai et al.
2017/0080523 A1 3/2017 Andersson et al.
2017/0218831 A1 8/2017 DeVouge et al.
2019/0321914 A1 10/2019 Denney et al.
2020/0232376 A1 7/2020 Quan
2020/0232377 A1 7/2020 Quan et al.

FOREIGN PATENT DOCUMENTS

CN 103603707 A 2/2014
CN 204163804 U 2/2015
CN 103014694 B 4/2015
CN 204851384 U 12/2015
CN 105813837 A 7/2016
CN 205840974 U 12/2016
CN 106285879 A 1/2017
DE 2706957 A1 8/1978
DE 2856889 A1 11/1980
DE 2839756 C2 8/1984
DE 102004039006 A1 2/2006
DE 102013106651 A1 1/2015
EP 0047678 A1 3/1982
EP 0328056 A2 8/1989
EP 0523008 B1 9/1996
EP 0808877 B1 9/2003
EP 1918544 A1 5/2008
EP 3112654 A1 1/2017
GB 1393232 A 5/1975
JP S6338524 B2 8/1988
JP S63285213 A 11/1988
JP 10296090 A 11/1998
JP H11140665 A 5/1999
JP 2000337126 A 12/2000
JP 2006144707 A 6/2006

(56) References Cited

FOREIGN PATENT DOCUMENTS

| | | | |
|---|---|---|---|
| JP | 3853903 | B2 | 12/2006 |
| JP | 2007308737 | A | 11/2007 |
| JP | 2009072695 | A | 4/2009 |
| JP | 2009215941 | A | 9/2009 |
| JP | 2010255520 | A | 11/2010 |
| JP | 2011027038 | A | 2/2011 |
| JP | 2011085113 | A | 4/2011 |
| JP | 4691707 | B2 | 6/2011 |
| JP | 5335595 | B2 | 11/2013 |
| JP | 2013238160 | A | 11/2013 |
| JP | 5529839 | B2 | 6/2014 |
| JP | 2015063985 | A | 4/2015 |
| JP | 5992768 | B2 | 9/2016 |
| JP | 6443138 | B2 | 12/2018 |
| KR | 100797823 | B1 | 1/2008 |
| KR | 20090071167 | A | 7/2009 |
| KR | 101262612 | B1 | 5/2013 |
| WO | 2016206915 | A1 | 12/2016 |
| WO | WO-201750711 | A1 | 3/2017 |

OTHER PUBLICATIONS

Office Action regarding Chinese Patent Application No. 202010032630.2, dated Jul. 27, 2021.

* cited by examiner

ACOUSTICALLY TUNED MUFFLER

CROSS-REFERENCE TO RELATED APPLICATIONS

This application claims the benefit of U.S. Provisional Application No. 62/598,147 filed on Dec. 13, 2017 and U.S. Provisional Application No. 62/568,421 filed on Oct. 5, 2017. The entire disclosures of each of the above applications are incorporated herein by reference.

FIELD

The present disclosure relates to an acoustically tuned muffler, and particularly, to an acoustically tuned muffler for an exhaust system for a combustion engine.

BACKGROUND

This section provides background information related to the present disclosure and is not necessarily prior art.

The flow of exhaust gas from an engine through one or more exhaust pipes can generate a substantial amount of noise. Mufflers have been used with exhaust systems to reduce this noise and/or tune the exhaust system so that exhaust gas flow therethrough generates a desired range of sounds. Tradeoffs between packaging space, performance, and sound characteristics are often made in the design of a muffler. The present disclosure provides a muffler that fits within limited space on a vehicle while providing a desired level of performance and desired sound characteristics.

SUMMARY

This section provides a general summary of the disclosure, and is not a comprehensive disclosure of its full scope or all of its features.

The present disclosure provides a muffler configured to receive exhaust gas from a combustion engine. The muffler may include a shell, a first baffle, a second baffle, a first inlet pipe, a first outlet pipe, a second outlet pipe, and a communication pipe. The first baffle is disposed within the shell and cooperates with the shell to define a first chamber. The second baffle is disposed within the shell and cooperates with the shell to define a second chamber. The first and second baffles cooperate with the shell to define a third chamber disposed between and separating the first and second chambers. The first baffle sealingly separates the first chamber from the third chamber. The second baffle sealingly separates the second chamber from the third chamber. The first inlet pipe may extend through the shell and may provide exhaust gas to at least one of the first and second chambers. The first outlet pipe may include a first inlet opening and a first outlet opening. The first inlet opening may be disposed within the first chamber such that exhaust gas in the first chamber exits the muffler through the first outlet opening. The second outlet pipe may include a second inlet opening and a second outlet opening. The second inlet opening may be disposed within the second chamber such that exhaust gas in the second chamber exits the muffler through the second outlet opening. The communication pipe may be disposed within the shell and may extend through the first and second baffles. The communication pipe may include a first opening, a second opening and a third opening. The first opening may be in communication with the first chamber. The second opening may be in communication with the second chamber. The third opening may be in communication with the third chamber. The first chamber may be in communication with the third chamber through the communication pipe. The second chamber may be in communication with the third chamber through the communication pipe.

In some configurations of the muffler of the above paragraph, the first and second chambers are in communication with the third chamber only through the communication pipe.

In some configurations of the muffler of either of the above paragraphs, exhaust gas enters and exits the third chamber only through the third opening in the communication pipe.

In some configurations of the muffler of any one or more of the above paragraphs, the first inlet pipe extends through the third chamber and through one or both of the first and second baffles.

In some configurations of the muffler of any one or more of the above paragraphs, the first inlet pipe includes an inlet tube, a first outlet tube and a second outlet tube. The inlet tube may be disposed at least partially within the third chamber. The first outlet tube is coupled with the inlet tube and may extend through the first baffle and into the first chamber. The second outlet tube is coupled with the inlet tube and may extend through the second baffle and into the second chamber.

In some configurations of the muffler of any one or more of the above paragraphs, the first inlet pipe extends through both of the first and second baffles and provides exhaust gas to the first chamber.

In some configurations of the muffler of any one or more of the above paragraphs, the muffler includes a second inlet pipe extending through both of the first and second baffles and providing exhaust gas to the second chamber.

In some configurations of the muffler of any one or more of the above paragraphs, the first inlet pipe is fluidly isolated from the second inlet pipe.

In some configurations of the muffler of any one or more of the above paragraphs, the first and second inlet pipes intersect each other and are in communication with each other such that exhaust gas entering the muffler through the first inlet pipe can flow into the second chamber through an outlet opening in the second inlet pipe and such that exhaust gas entering the muffler through the second inlet pipe can flow into the first chamber through an outlet opening in the first inlet pipe.

In some configurations of the muffler of any one or more of the above paragraphs, the shell includes a first end cap and a second end cap. The first end cap may partially define the first chamber, and the second end cap may partially define the second chamber.

In some configurations of the muffler of any one or more of the above paragraphs, the first outlet pipe extends through the first end cap, and the second outlet pipe extends through the second end cap.

In another form, the present disclosure provides a muffler that may include a shell, first and second baffles, one or more inlet pipes, first and second outlet pipes, and a communication pipe. The first baffle is disposed within the shell and cooperates with the shell to define a first chamber. The second baffle is disposed within the shell and cooperates with the shell to define a second chamber. The first and second baffles cooperate with the shell to define a third chamber that is disposed between and separates the first and second chambers. The first baffle sealingly separates the first chamber from the third chamber. The second baffle sealingly separates the second chamber from the third chamber. The one or more inlet pipes may be attached to the shell and provide exhaust gas from the combustion engine to the first and second chambers. The first outlet pipe is at least partially disposed within the first chamber. Exhaust gas in the first chamber may exit the muffler through the first outlet pipe. The second outlet pipe is at least partially disposed within the second chamber. Exhaust gas in the second chamber may exit the muffler through the second outlet pipe. The communication pipe may be disposed within the shell and may extend through the first and second baffles. The communication pipe may include a first axial end, a second axial end and an intermediate portion disposed between the first and second axial ends. The first axial end may be disposed within the first chamber and may include a first opening. The second axial end may be disposed within the second chamber and may include a second opening. The intermediate portion may be disposed within the third chamber and may include a third opening. The first chamber may be in communication with the third chamber through the communication pipe. The second chamber may be in communication with the third chamber through the communication pipe.

In some configurations of the muffler of the above paragraph, the first and second chambers are in communication with the third chamber only through the communication pipe.

In some configurations of the muffler of either of the above paragraphs, exhaust gas enters and exits the third chamber only through the third opening in the communication pipe.

In some configurations of the muffler of any one or more of the above paragraphs, the one or more inlet pipes includes a first inlet pipe extending through the third chamber and through one or both of the first and second baffles.

In some configurations of the muffler of any one or more of the above paragraphs, the first inlet pipe includes an inlet tube, a first outlet tube and a second outlet tube. The inlet tube may be disposed at least partially within the third chamber. The first outlet tube may be coupled with the inlet tube and may extend through the first baffle and into the first chamber. The second outlet tube may be coupled with the inlet tube and may extend through the second baffle and into the second chamber.

In some configurations of the muffler of any one or more of the above paragraphs, the first inlet pipe extends through both of the first and second baffles and provides exhaust gas to the first chamber.

In some configurations of the muffler of any one or more of the above paragraphs, the one or more inlet pipes includes a second inlet pipe extending through both of the first and second baffles and providing exhaust gas to the second chamber.

In some configurations of the muffler of any one or more of the above paragraphs, the first inlet pipe is fluidly isolated from the second inlet pipe.

In some configurations of the muffler of any one or more of the above paragraphs, the first and second inlet pipes intersect each other and are in communication with each other such that exhaust gas entering the muffler through the first inlet pipe can flow into the second chamber through an outlet opening in the second inlet pipe and such that exhaust gas entering the muffler through the second inlet pipe can flow into the first chamber through an outlet opening in the first inlet pipe.

In some configurations of the muffler of any one or more of the above paragraphs, the shell includes a first end cap and a second end cap. The first end cap may partially define the first chamber. The second end cap may partially define the second chamber.

In some configurations of the muffler of any one or more of the above paragraphs, the first outlet pipe extends through the first end cap, and the second outlet pipe extends through the second end cap.

In another form, the present disclosure provides a muffler that may include a shell, an inlet pipe, an outlet pipe, and a communication pipe. The shell may define a plurality of internal chambers. The inlet pipe may be attached to the shell and may provide exhaust gas from a combustion engine to one of the chambers. The outlet pipe may be attached to the shell and may be in communication with the one of the chambers. Exhaust gas in the one of the chambers may exit the muffler through the outlet pipe. The communication pipe may be disposed within the shell and may extend into the chambers. The communication pipe may include a plurality of openings. Each of the openings may be in direct communication with a respective one of the chambers. Exhaust gas may enter and exit one of the chambers only through the communication pipe.

In some configurations of the muffler of the above paragraph, the muffler includes a baffle disposed within the shell and separating the chambers from each other.

In some configurations of the muffler of either of the above paragraphs, the inlet pipe extends at least partially through the chambers and through the baffle.

In some configurations of the muffler of any one or more of the above paragraphs, the inlet pipe includes an inlet tube, a first outlet tube and a second outlet tube.

In some configurations of the muffler of any one or more of the above paragraphs, the muffler includes another inlet pipe extending through the chambers and through the baffle.

In some configurations of the muffler of any one or more of the above paragraphs, exhaust gas within the inlet pipe is isolated from exhaust gas within one of the chambers.

In another form, the present disclosure provides a muffler that may include a shell, a baffle, an inlet pipe, and a pair of outlet pipes. The baffle may be disposed within the shell and may cooperate with the shell to define a pair of chambers. The inlet pipe may extend through the shell and provide exhaust gas to one of the chambers. The pair of outlet pipes may be communication with the one of the chambers. The outlet pipes may extend through the baffle and the shell and may include openings through which exhaust gas exits the muffler. Each of the outlet pipes may include a Helmholtz neck that is open to the other one of the chambers.

In another form, the present disclosure provides a muffler that may include a shell, first and second inlet pipes, a pair of baffles, a pair of outlet pipes, and a pair of Helmholtz necks. The first and second inlet pipes may extend through the shell and provide exhaust gas to a mixing chamber. The pair of baffles may define first and second chambers receiving exhaust gas from the first and second inlet pipes. The pair of outlet pipes may receive exhaust gas from the first and second chambers. The pair of Helmholtz necks may be disposed downstream of the mixing chamber. The Helmholtz necks may be open to an enclosed chamber disposed between the first and second chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
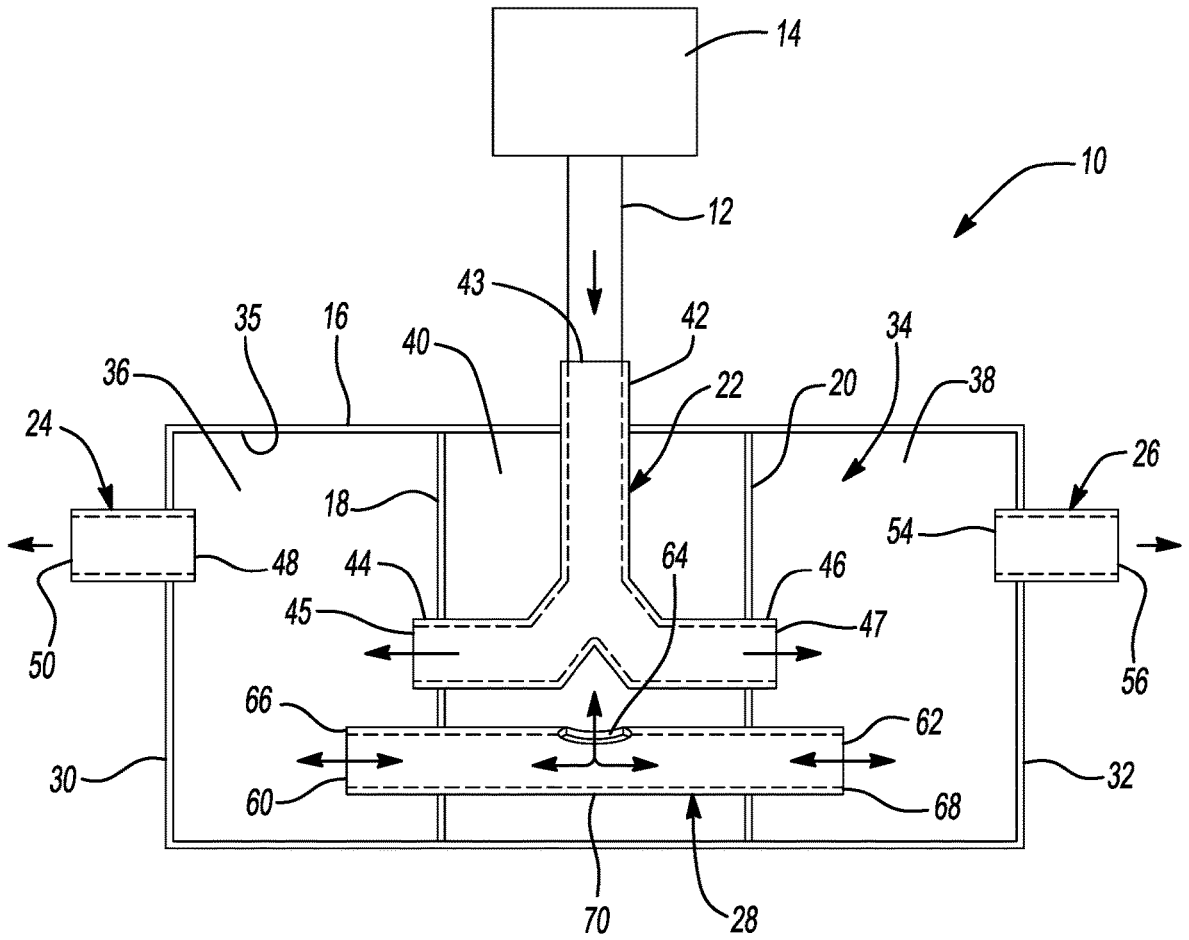
FIG. 1 is a schematic representation of an engine and exhaust system having a muffler according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a muffler 10 is provided that may receive exhaust gas from one or more exhaust pipes 12 (shown schematically in FIG. 1) connected to a combustion engine 14 (shown schematically in FIG. 1). The muffler 10 may be shaped to fit within a given available space on a vehicle (not shown). For example, in some configurations, the muffler 10 may be shaped to fit around a spare tire well of the vehicle and/or other components at or near an undercarriage of the vehicle.

The muffler 10 may include a shell 16, a first internal baffle 18, a second internal baffle 20, an inlet pipe 22, a first outlet pipe 24, a second outlet pipe 26, and an internal communication pipe 28. A first end cap 30 and a second end cap 32 may be fixed to respective axial ends of the shell 16 and may cooperate with the shell 16 to define an internal volume 34. The first and second end caps 30, 32 may be welded, mechanically locked, or otherwise sealingly fixed onto the axial ends of the shell 16. In some configurations, the shell 16 could have a "clamshell" configuration whereby the shell 16 includes two shell halves (or two shell portions) that are welded, mechanically locked, or otherwise sealingly fixed together. In some of such configurations, some or all of each end cap 30, 32 could be integrally formed with or attached to the shell halves (or portions) of the shell 16. Other multi-piece shell configurations are contemplated. For example, muffler 10 may include an outer shell surrounding an inner shell.

Figure 4:
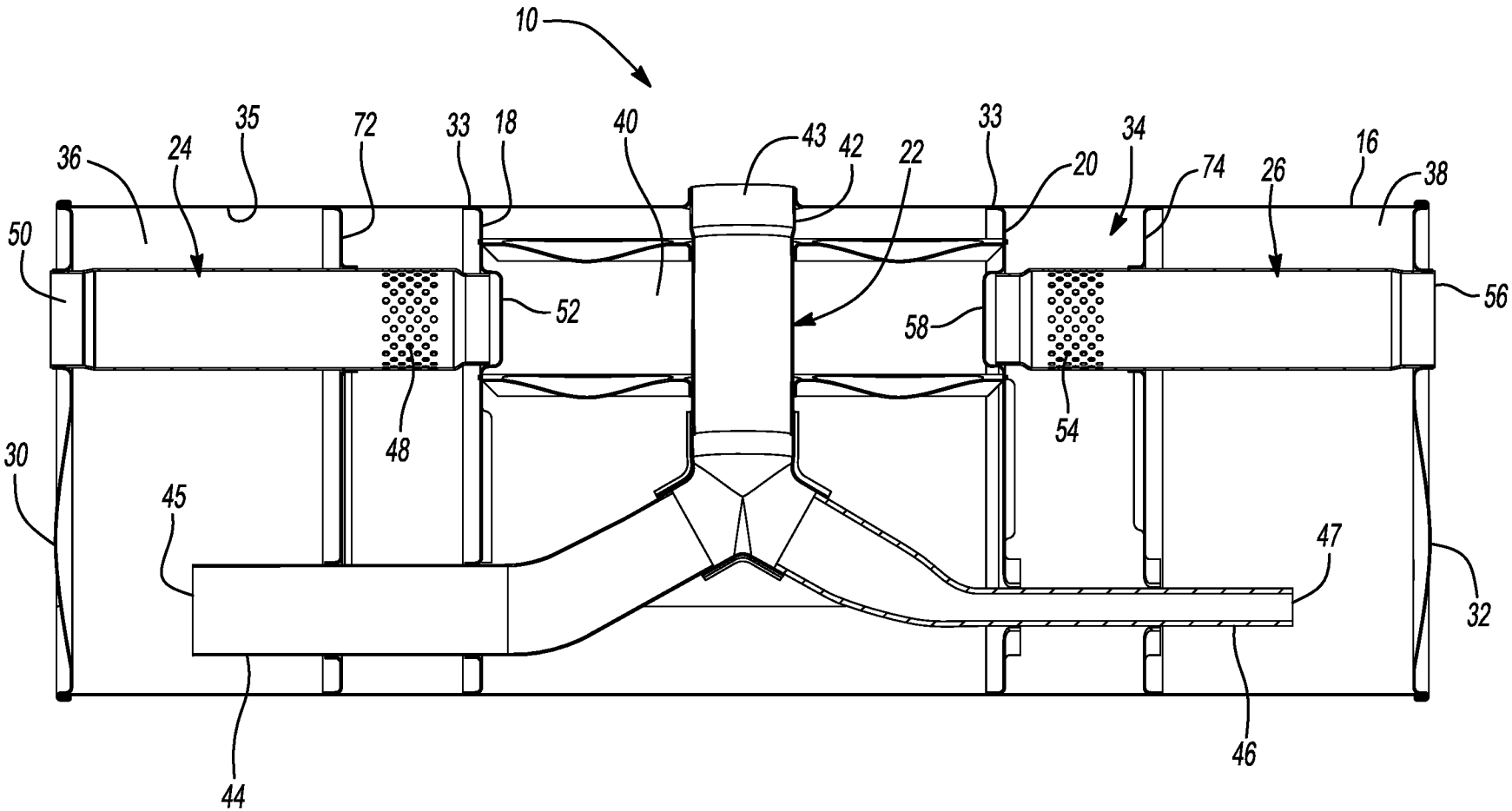
FIG. 4 is a cross-sectional view of the muffler of FIG. 1.

The first and second internal baffles 18, 20 may be disposed within the shell 16 and between the first and second end caps 30, 32. That is, the first and second internal baffles 18, 20 may be disposed within the internal volume 34. The outer peripheries 33 of the first and second baffles 18, 20 may be shaped to generally match the contours of the inner circumferential wall 35 of the shell 16. As shown in FIG. 4, the outer peripheries 33 of the first and second baffles 18, 20 may be welded, mechanically locked, or otherwise sealingly fixed to the inner circumferential wall 35.

The first and second internal baffles 18, 20 may divide the internal volume 34 into a first enclosed chamber 36, a second enclosed chamber 38, and a third enclosed chamber (i.e., an intermediate chamber) 40. The first chamber 36 may be defined by the first internal baffle 18, the first end cap 30 and the shell 16. The second chamber 38 may be defined by the second internal baffle 20, the second end cap 32 and the shell 16. The third chamber 40 is disposed between the first and second chambers 36, 38 and may be defined by the shell 16 and the first and second internal baffles 18, 20. The first and second internal baffles 18, 20 may seal off the third chamber 40 from the first and second chambers 36, 38 such that the first, second and third chambers 36, 38, 40 are only in communication with each other via the internal communication pipe 28, as will be described in more detail below.

The inlet pipe 22 may include an inlet tube 42, a first outlet tube 44, and a second outlet tube 46. In the configuration shown in FIGS. 1-4, the inlet pipe 22 is generally Y-shaped, but in other configurations, the inlet pipe 22 may have other shapes. The inlet tube 42 of the inlet pipe 22 may be fluidly coupled with the exhaust pipe 12 (via an inlet opening 43 in the inlet tube 42) and may extend through the shell 16 and into the third chamber 40. The first outlet tube 44 may extend through the first baffle 18 and into the first chamber 36. The first outlet tube 44 may include a first outlet opening 45 in fluid communication with the first chamber 36. The second outlet tube 46 may extend through the second baffle 20 and into the second chamber 38. The second outlet tube 46 may include a second outlet opening 47 in fluid communication with the second chamber 38. In this manner, exhaust gas from the exhaust pipe 12 may flow into the inlet pipe 22 through the inlet opening 43 and may flow into the first and second chambers 36, 38 via the first and second outlet openings 45, 47, respectively. While a portion of the inlet pipe 22 extends through the third chamber 40, the inlet pipe 22 is not in direct fluid communication with the third chamber 40 (i.e., there are no openings in any portion of the inlet pipe 22 disposed within the third chamber 40 such that fluid in the inlet pipe 22 is isolated from the third chamber 40).

The first outlet pipe 24 may be at least partially disposed within the first chamber 36 and may extend through the first end cap 30 (or through the shell 16). The first outlet pipe 24 may include one or more inlet openings 48 and an outlet opening 50. The inlet openings 48 may be in fluid communication with the first chamber 36. The outlet opening 50 is open to the ambient environment surrounding the muffler 10 or the outlet opening 50 could be coupled to another exhaust system component outside of the muffler 10 (e.g., a tailpipe; not shown). In this manner, fluid in the first chamber 36 can exit the muffler 10 by flowing into the inlet openings 48 of the first outlet pipe 24 and through the outlet opening 50 of the first outlet pipe 24. In some configurations, the muffler 10 could include two or more first outlet pipes 24 that are in fluid communication with the first chamber 36 and extend through the first end cap 30 (or shell 16) such that fluid in the first chamber 36 can exit the muffler 10 through the first outlet pipes 24.

Figure 2:
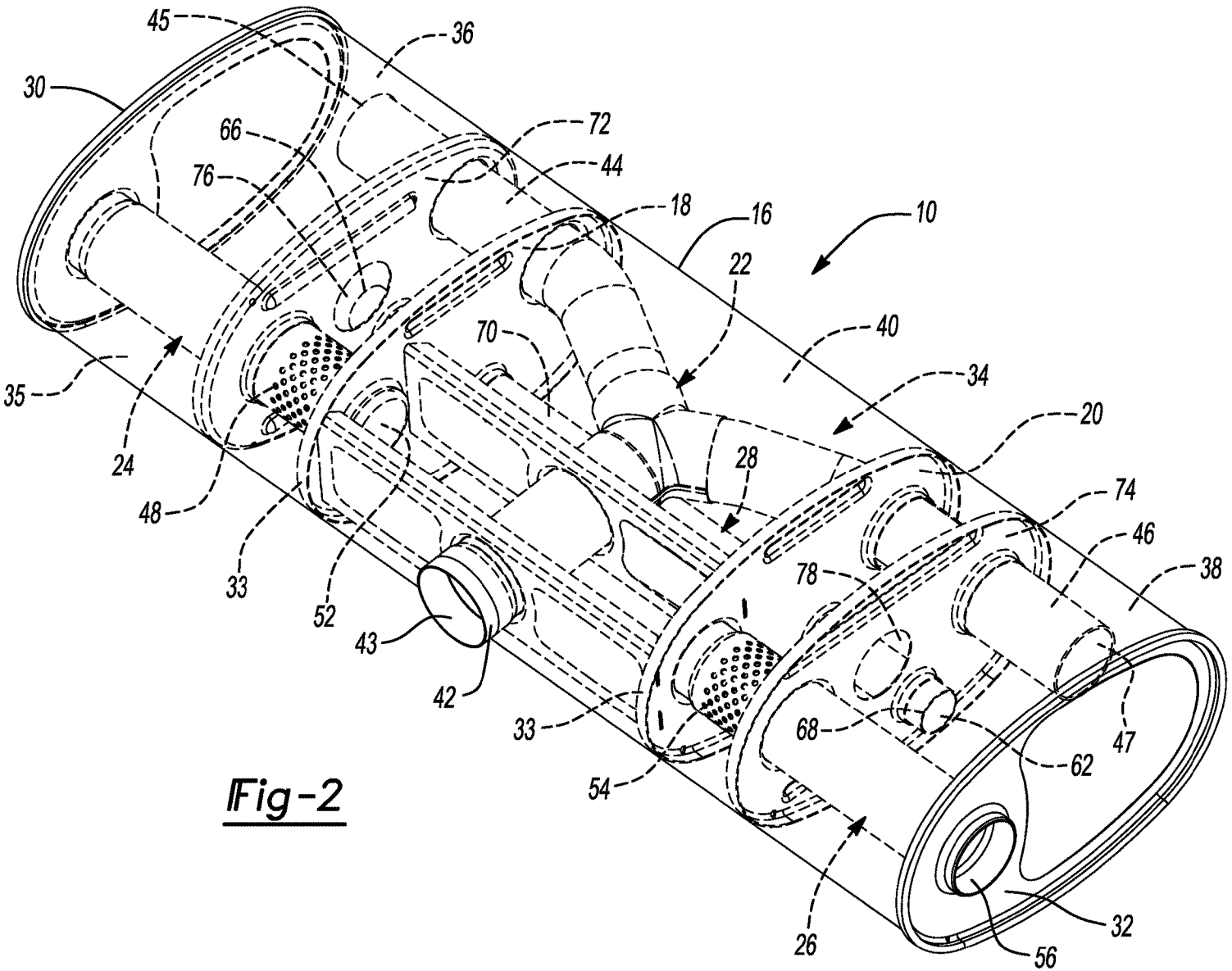
FIG. 2 is a perspective view of the muffler of FIG. 1.
Figure 3:
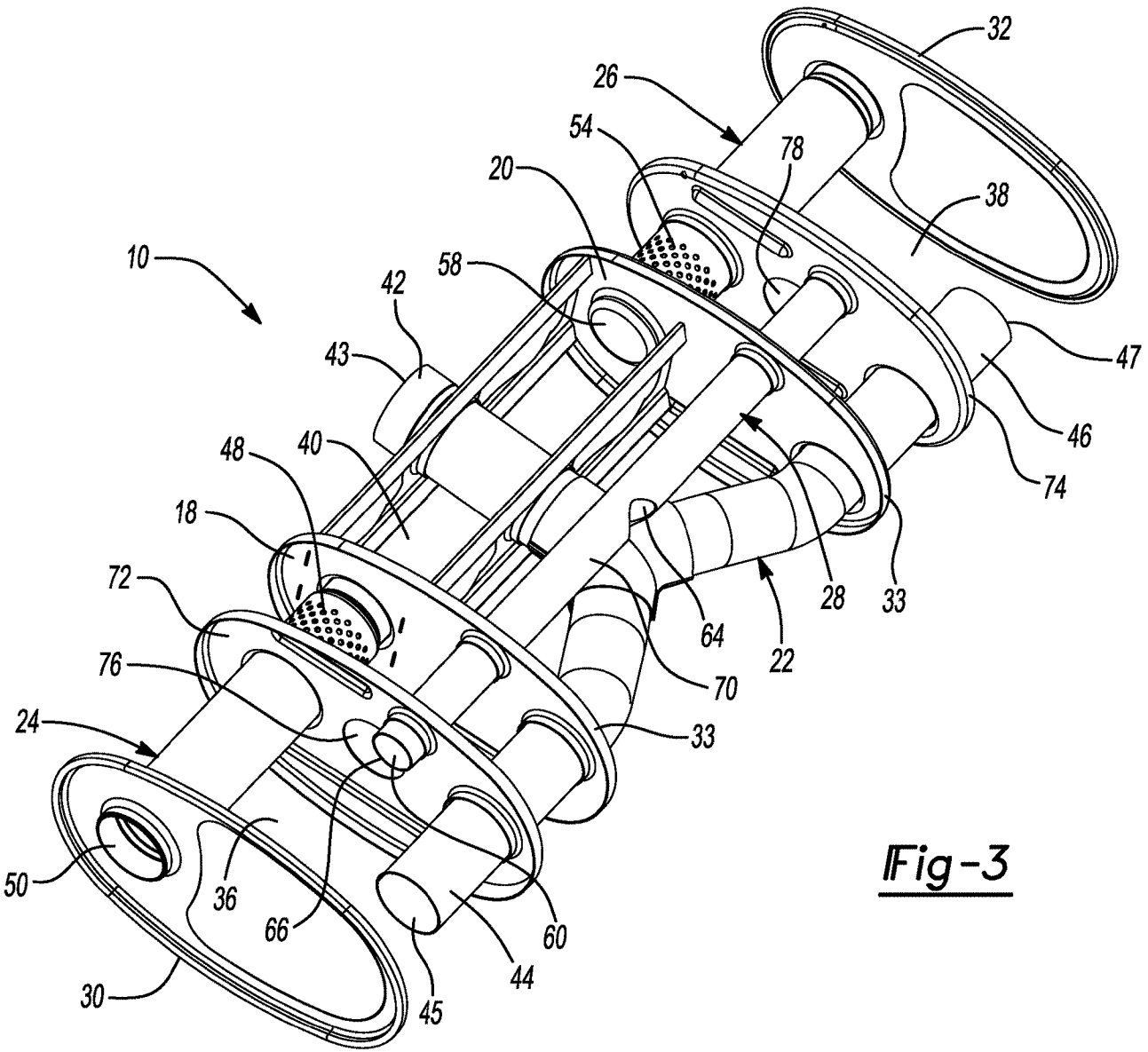
FIG. 3 is a partial perspective view of the muffler of FIG. 1.

In the particular configuration shown in FIGS. 2-4, the inlet openings 48 of the first outlet pipe 24 extend radially through inner and outer diametrical surfaces of the first outlet pipe 24, and an axial end 52 of the first outlet pipe 24 is closed or capped. Therefore, while the axial end 52 of the first outlet pipe 24 may be supported by the first baffle 18 or even extend slightly into the third chamber 40, the first outlet pipe 24 is not in direct fluid communication with the third chamber 40. Rather, all of the inlet openings 48 of the first outlet pipe 24 are disposed in the first chamber 36 such that only fluid from the first chamber 36 can exit the muffler 10 through the first outlet pipe 24.

The second outlet pipe 26 may be at least partially disposed within the second chamber 38 and may extend through the second end cap 32 (or through the shell 16). The second outlet pipe 26 may include one or more inlet openings 54 and an outlet opening 56. The inlet openings 54 may be in fluid communication with the second chamber 38. The outlet opening 56 is open to the ambient environment surrounding the muffler 10 or the outlet opening 56 could be coupled to another exhaust system component outside of the muffler 10 (e.g., a tailpipe; not shown). In this manner, fluid in the second chamber 38 can exit the muffler 10 by flowing into the inlet openings 54 of the second outlet pipe 26 and through the outlet opening 56 of the second outlet pipe 26. In some configurations, the muffler 10 could include two or more second outlet pipes 26 that are in fluid communication with the second chamber 38 and extend through the second end cap 32 (or shell 16) such that fluid in the second chamber 38 can exit the muffler 10 through the second outlet pipes 26.

In the particular configuration shown in FIGS. 2-4, the inlet openings 54 of the second outlet pipe 26 extend radially through inner and outer diametrical surfaces of the second outlet pipe 26, and an axial end 58 of the second outlet pipe 26 is closed or capped. Therefore, while the axial end 58 of the second outlet pipe 26 may be supported by the second baffle 20 or even extend slightly into the third chamber 40, the second outlet pipe 26 is not in direct fluid communication with the third chamber 40. Rather, all of the inlet openings 54 of the second outlet pipe 26 are disposed in the second chamber 38 such that only fluid from the second chamber 38 can exit the muffler 10 through the second outlet pipe 26.

The internal communication pipe 28 may extend through the third chamber 40 and through the first and second baffles 18, 20 and into the first and second chambers 36, 38. The internal communication pipe 28 may include a first opening 60, a second opening 62, and a third opening 64. The first opening 60 may be formed in a first axial end 66 of the internal communication pipe 28 that is disposed within the first chamber 36 such that the first opening 60 is in direct fluid communication with the first chamber 36. The second opening 62 may be formed in a second axial end 68 of the internal communication pipe 28 that is disposed within the second chamber 38 such that the second opening 62 is in direct fluid communication with the second chamber 38. The third opening 64 may be formed in an intermediate portion 70 of the internal communication pipe 28 that is disposed between the first and second axial ends 66, 68 and within the third chamber 40 such that the third opening 64 is in direct fluid communication with the third chamber 40. That is, the third opening 64 extends radially through inner and outer diametrical surfaces of the internal communication pipe 28. In this manner, the first and second chambers 36, 38 can communicate with each other and with the third chamber 40 via the internal communication pipe 28.

As shown in FIGS. 1-3, the internal communication pipe 28 includes only the single third opening 64 in direct fluid communication with the third chamber 40. The lengths and diameters of the pipes 22, 24, 26, 28, volumes of the chambers 36, 38, 40, the size of the third opening 64 in the internal communication pipe 28, the distances between the first and second openings 60, 62, the distances between the first and third openings 60, 64, and/or the distances between the second and third openings 62, 64 may be tailored to achieve a desired range of sounds and desired performance characteristics over a given range of engine speeds. The single internal communication pipe 28 with the single opening 64 communicating directly with the third chamber 40 provides the desired acoustical characteristics. In some configurations, the third opening 64 may have a diameter that is approximately equal to the inner diameter or the outer diameter of the communication pipe 28. In some configurations, the third opening 64 may have a diameter that is larger or smaller than the inner diameter or the outer diameter of the communication pipe 28. In some configurations, the third opening 64 could be configured as a concentric pipe Helmholtz resonator. In some configurations, the third opening 64 may be an oval or slot with an open area substantially the same as the first and second openings 60, 62. In some configurations, a length that the communication pipe 28 extends into the first and second chambers 36, 38 will allow for acoustic tuning of the muffler 10 without changing the position of the baffles 18, 20. In some configurations, the diameters of the first, second and third openings 60, 62, 64 of the communication pipe 28 may have the same diameters.

In the particular configuration shown in FIGS. 2-4, a first support member 72 may be disposed within the first chamber 36 and may support the first outlet pipe 24, the first outlet tube 44 of the inlet pipe 22, and an end of the internal communication pipe 28. Furthermore, a second support member 74 may be disposed within the second chamber 38 and may support the second outlet pipe 26, the second outlet tube 46 of the inlet pipe 22, and another end of the internal communication pipe 28. The first and second support members 72, 74 may be shaped similarly to the first and second baffles 18, 20, but include one or more apertures 76, 78 extending therethrough.

While the muffler 10 is described above as receiving exhaust gas from the engine 14 through the inlet pipe 22 and exhaust gas exiting the muffler 10 through the outlet pipes 24, 26, in some configurations, the outlet pipes 24, 26 may be coupled to the exhaust pipe 12 to receive exhaust gas into the muffler 10 and exhaust gas may exit the muffler 10 through the inlet pipe 22.

Figure 5:
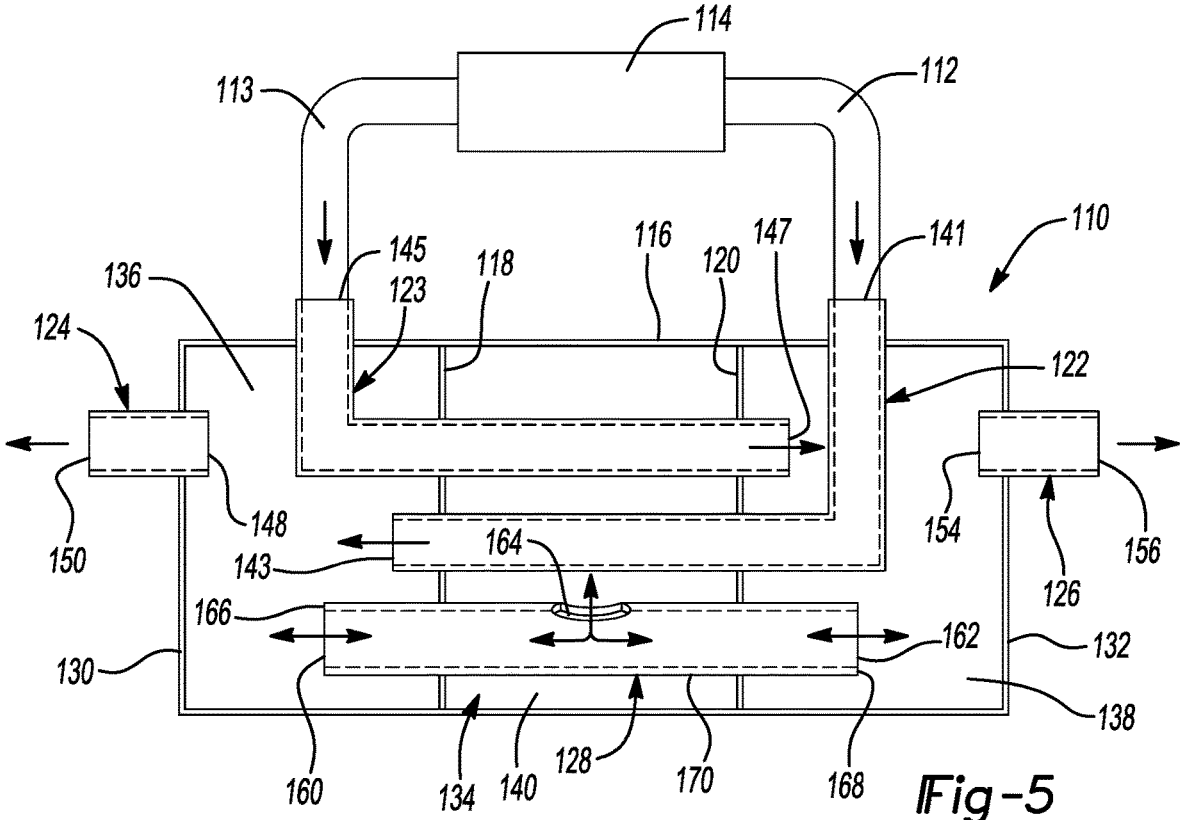
FIG. 5 is a schematic representation of another engine and exhaust system having another muffler according to the principles of the present disclosure.

With reference to FIG. 5, another muffler 110 is provided that may receive exhaust gas from first and second exhaust pipes 112, 113 connected to a combustion engine 114. The muffler 110 may include a shell 116, a first internal baffle 118, a second internal baffle 120, a first inlet pipe 122, a second inlet pipe 123, a first outlet pipe 124, a second outlet pipe 126, and an internal communication pipe 128. A first end cap 130 and a second end cap 132 may be fixed to respective axial ends of the shell 116 and may cooperate with the shell 116 to define an internal volume 134. The first and second end caps 130, 132 may be welded, mechanically locked, or otherwise sealingly fixed onto the axial ends of the shell 116. In some configurations, the shell 116 could have a "clamshell" configuration whereby the shell 116 includes two shell halves (or two shell portions) that are welded, mechanically locked, or otherwise sealingly fixed together. In some of such configurations, some or all of each end cap 130, 132 could be integrally formed with or attached to the shell halves (or portions) of the shell 116.

The first and second internal baffles 118, 120 may be disposed within the shell 116 and between the first and second end caps 130, 132. That is, the first and second internal baffles 118, 120 may be disposed within the internal volume 134. The structure and function of the first and second internal baffles 118, 120 may be similar or identical to that of the first and second internal baffles 18, 20 described above.

As described above, the first and second internal baffles 118, 120 may divide the internal volume 134 into a first enclosed chamber 136, a second enclosed chamber 138, and a third enclosed chamber (i.e., an intermediate chamber) 140. The first chamber 136 may be defined by the first internal baffle 118, the first end cap 130 and the shell 116. The second chamber 138 may be defined by the second internal baffle 120, the second end cap 132 and the shell 116. The third chamber 140 is disposed between the first and second chambers 136, 138 and may be defined by the shell 116 and the first and second internal baffles 118, 120. The first and second internal baffles 118, 120 may seal off the third chamber 140 from the first and second chambers 136, 138 such that the first, second and third chambers 136, 138, 140 are only in communication with each other via the internal communication pipe 128.

The first inlet pipe 122 may extend through the shell 116 (or through the second end cap 132) and may extend through the second chamber 138, through the second baffle 120, through the third chamber 140, through the first baffle 118, and into the first chamber 136. The first inlet pipe 122 may include an inlet opening 141 and an outlet opening 143. The inlet opening 141 may be coupled to the first exhaust pipe 112. The outlet opening 143 may be open to and in fluid communication with the first chamber 136. While the first inlet pipe 122 extends through the second and third chambers 138, 140, the first inlet pipe 122 is not in direct fluid communication with the second chamber 138 or the third chamber 140 (i.e., there are no openings in any portion of the first inlet pipe 122 disposed within the second or third chambers 138, 140 such that fluid in the first inlet pipe 122 is isolated from the second and third chambers 138, 140).

The second inlet pipe 123 may extend through the shell 116 (or through the first end cap 130) and may extend through the first chamber 136, through the first baffle 118, through the third chamber 140, through the second baffle 120, and into the second chamber 138. The second inlet pipe 123 may include an inlet opening 145 and an outlet opening 147. The inlet opening 145 may be coupled to the second exhaust pipe 113. The outlet opening 147 may be open to and in fluid communication with the second chamber 138. While the second inlet pipe 123 extends through the first and third chambers 136, 140, the second inlet pipe 123 is not in direct fluid communication with the first chamber 136 or the third chamber 140 (i.e., there are no openings in any portion of the second inlet pipe 123 disposed within the first or third chambers 136, 140 such that fluid in the second inlet pipe 123 is isolated from the first and third chambers 136, 140).

The first outlet pipe 124 may be at least partially disposed within the first chamber 136 and may extend through the first end cap 130 (or through the shell 116). The first outlet pipe 124 may include one or more inlet openings 148 and an outlet opening 150. The inlet opening 148 may be in fluid communication with the first chamber 136. The outlet opening 150 is open to the ambient environment surrounding the muffler 110 or the outlet opening 150 could be coupled to another exhaust system component outside of the muffler 110 (e.g., a tailpipe; not shown). In this manner, fluid in the first chamber 136 can exit the muffler 110 by flowing into the inlet opening 148 of the first outlet pipe 124 and through the outlet opening 150 of the first outlet pipe 124. In some configurations, the muffler 110 could include two or more first outlet pipes 124 that are in fluid communication with the first chamber 136 and extend through the first end cap 130 (or shell 116) such that fluid in the first chamber 136 can exit the muffler 110 through the first outlet pipes 124.

The second outlet pipe 126 may be at least partially disposed within the second chamber 138 and may extend through the second end cap 132 (or through the shell 116). The second outlet pipe 126 may include one or more inlet openings 154 and an outlet opening 156. The inlet opening 154 may be in fluid communication with the second chamber 138. The outlet opening 156 is open to the ambient environment surrounding the muffler 110 or the outlet opening 156 could be coupled to another exhaust system component outside of the muffler 110 (e.g., a tailpipe; not shown). In this manner, fluid in the second chamber 138 can exit the muffler 110 by flowing into the inlet opening 154 of the second outlet pipe 126 and through the outlet opening 156 of the second outlet pipe 126. In some configurations, the muffler 110 could include two or more second outlet pipes 126 that are in fluid communication with the second chamber 138 and extend through the second end cap 132 (or shell 116) such that fluid in the second chamber 138 can exit the muffler 110 through the second outlet pipes 126.

The internal communication pipe 128 may extend through the third chamber 140 and through the first and second baffles 118, 120 and into the first and second chambers 136, 138. The internal communication pipe 128 may include a first opening 160, a second opening 162, and a third opening 164. The first opening 160 may be formed in a first axial end 166 of the internal communication pipe 128 that is disposed within the first chamber 136 such that the first opening 160 is in direct fluid communication with the first chamber 136. The second opening 162 may be formed in a second axial end 168 of the internal communication pipe 128 that is disposed within the second chamber 138 such that the second opening 162 is in direct fluid communication with the second chamber 138. The third opening 164 may be formed in an intermediate portion 170 of the internal communication pipe 128 that is disposed between the first and second axial ends 166, 168 and within the third chamber 140 such that the third opening 164 is in direct fluid communication with the third chamber 140. That is, the third opening 164 extends radially through inner and outer diametrical surfaces of the internal communication pipe 128. In this manner, the first and second chambers 136, 138 can communicate with each other and with the third chamber 140 via the internal communication pipe 128.

Figure 5A:
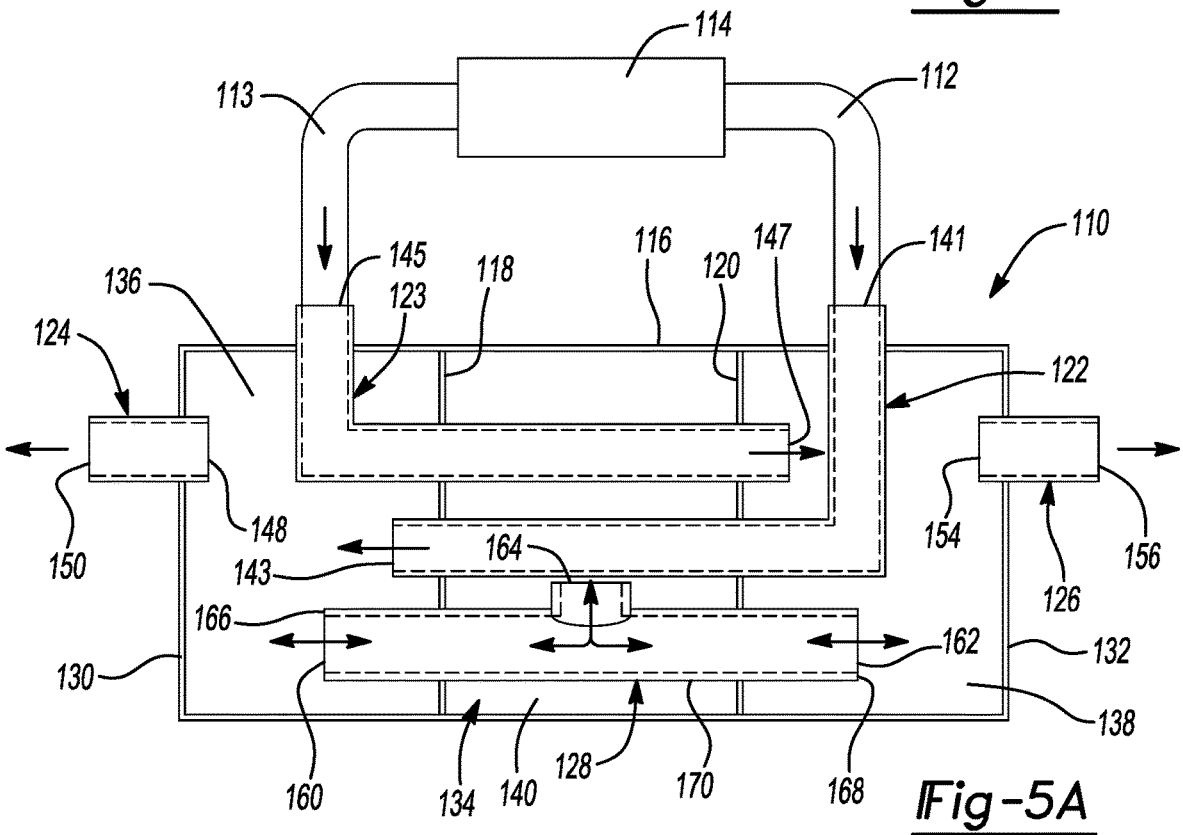
FIG. 5A is a schematic representation of another engine and exhaust system having another muffler according to the principles of the present disclosure.
Figure 5B:
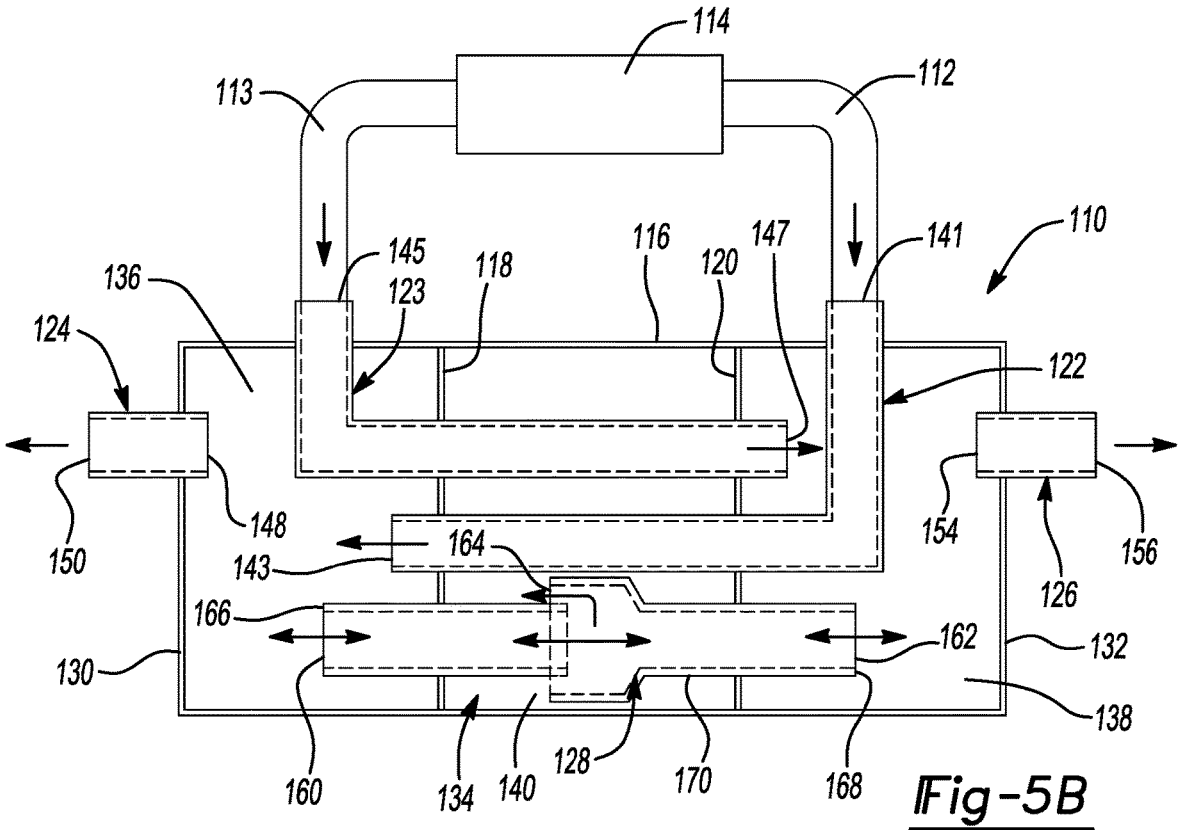
FIG. 5B is a schematic representation of another engine and exhaust system having another muffler according to the principles of the present disclosure.

The internal communication pipe 128 includes only the single third opening 164 in direct fluid communication with the third chamber 140. The lengths and diameters of the pipes 122, 123, 124, 126, 128, volumes of the chambers 136, 138, 140, and the size of the third opening 164 in the internal communication pipe 128, the distances between the first and second openings 160, 162, the distances between the first and third openings 160, 164, and/or the distances between the second and third openings 162, 164 may be tailored to achieve a desired range of sounds and desired performance characteristics over a given range of engine speeds. The single internal communication pipe 128 with the single opening 164 communicating directly with the third chamber 140 provides the desired acoustical characteristics. In some configurations, the third opening 164 may have a diameter that is approximately equal to the inner diameter or the outer diameter of the communication pipe 128. In some configurations, the third opening 164 may have a diameter that is larger or smaller than the inner diameter or the outer diameter of the communication pipe 128. In some configurations, the third opening 164 could be configured as a concentric pipe Helmholtz resonator. FIGS. 5A and 5B depict alternate embodiment construction schemes. FIG. 5A shows a stub pipe extending perpendicular to communication pipe 128. Third opening 164 is at the end of the stub pipe. FIG. 5B shows a flared portion of communication pipe 128 at least partially concentrically overlapping a spaced apart portion of communication pipe 128. In some configurations, the third opening 164 may be an oval or slot with an open area substantially the same as the first and second openings 160, 162. In some configurations, a length that the communication pipe 128 extends into the first and second chambers 136, 138 will allow for acoustic tuning of the muffler 110 without changing the position of the baffles 118, 120. In some configurations, the diameters of the first, second and third openings 160, 162, 164 of the communication pipe 128 may have the same diameters.

While the muffler 110 is described above as receiving exhaust gas from the engine 114 through the inlet pipes 122, 123 and exhaust gas exiting the muffler 110 through the outlet pipes 124, 126, in some configurations, the outlet pipes 124, 126 may be coupled to the exhaust pipes 112, 113 to receive exhaust gas into the muffler 110 and the exhaust gas may exit the muffler 110 through the inlet pipes 122, 123.

Figure 6:
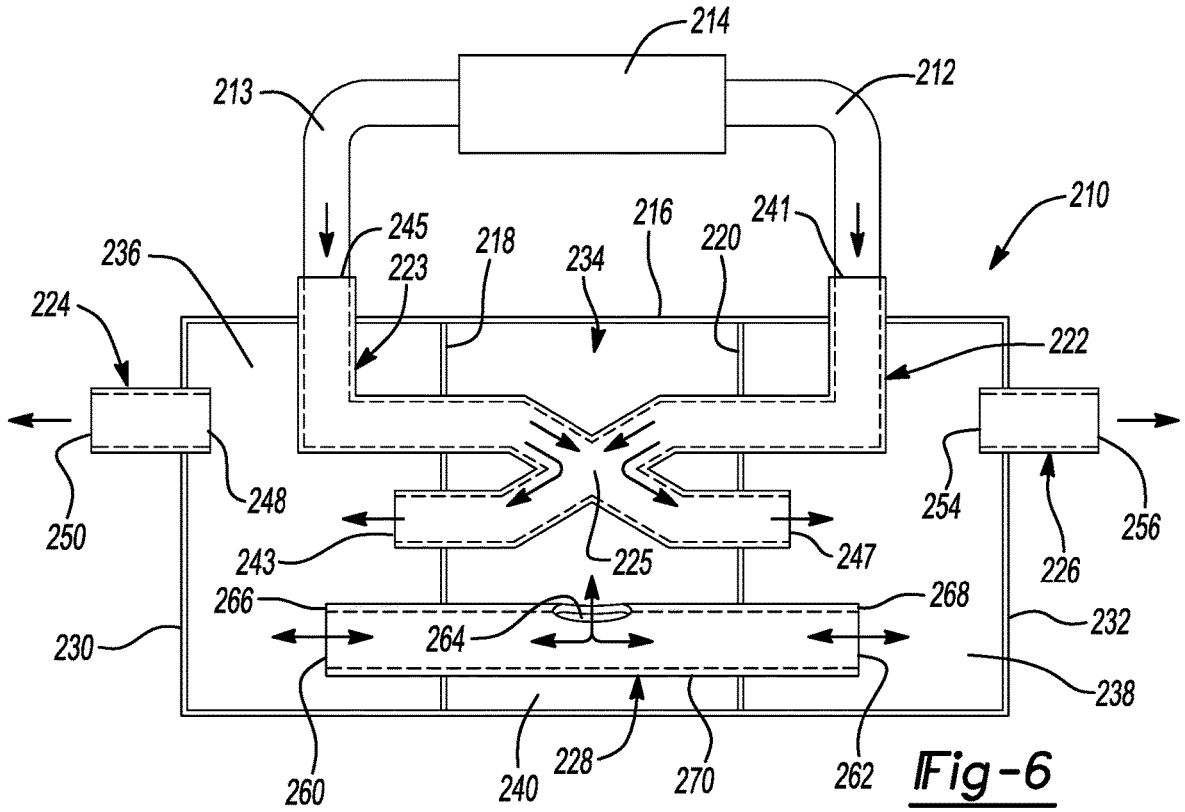
FIG. 6 is a schematic representation of yet another engine and exhaust system having yet another muffler according to the principles of the present disclosure.
Figure 7:
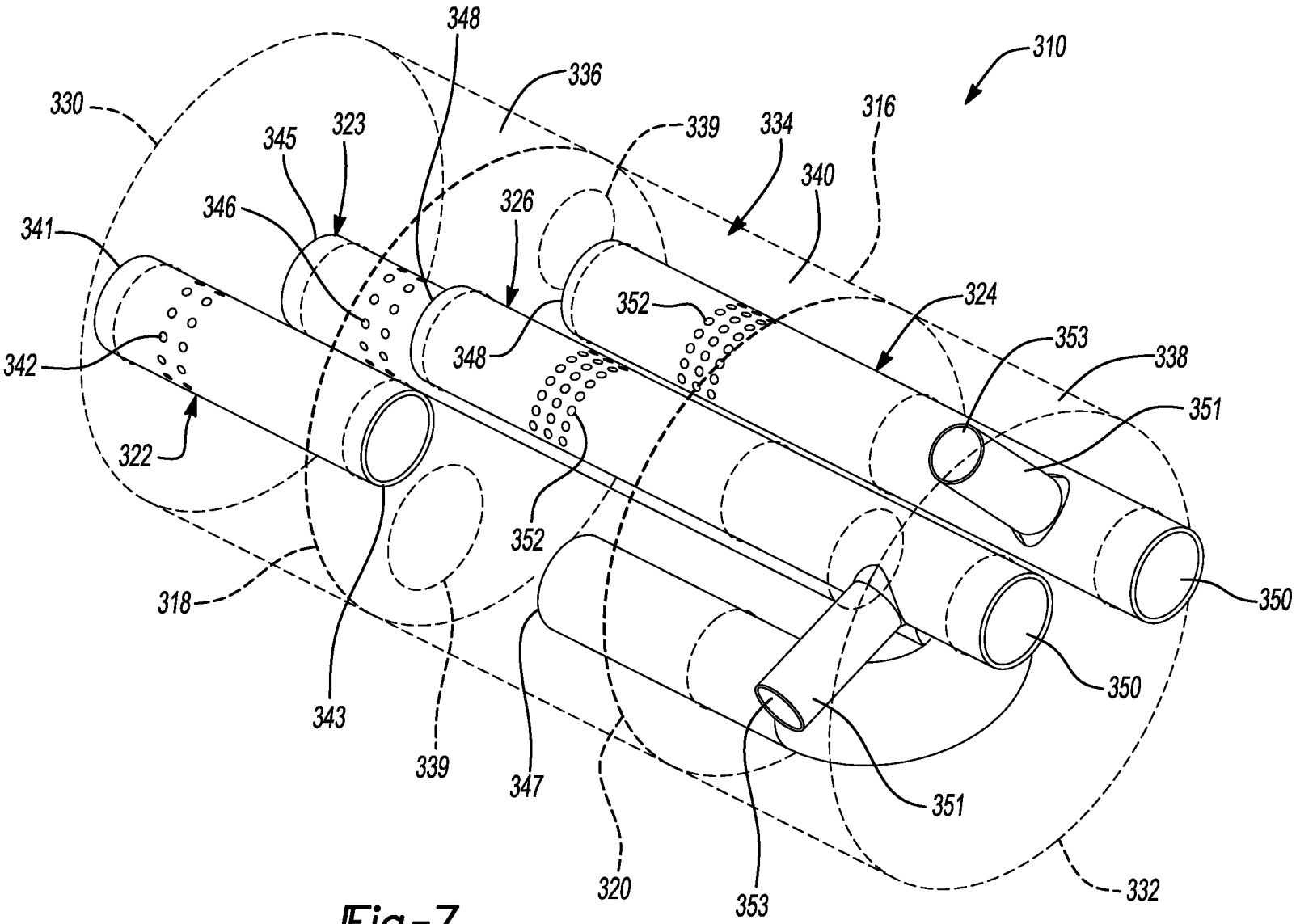
FIG. 7 is a perspective view of another muffler according to the principles of the present disclosure.

With reference to FIG. 6, another muffler 210 is provided that may receive exhaust gas from first and second exhaust pipes 212, 213 connected to a combustion engine 214. The muffler 210 may include a shell 216, a first internal baffle 218, a second internal baffle 220, a first inlet pipe 222, a second inlet pipe 223, a first outlet pipe 224, a second outlet pipe 226, and an internal communication pipe 228. A first end cap 230 and a second end cap 232 may be fixed to respective axial ends of the shell 216 and may cooperate with the shell 216 to define an internal volume 234. The first and second end caps 230, 232 may be welded, mechanically locked, or otherwise sealingly fixed onto the axial ends of the shell 216. In some configurations, the shell 216 could have a "clamshell" configuration whereby the shell 216 includes two shell halves (or two shell portions) that are welded, mechanically locked, or otherwise sealingly fixed together. In some of such configurations, some or all of each end cap 230, 232 could be integrally formed with or attached to the shell halves (or portions) of the shell 216.

The first and second internal baffles 218, 220 may be disposed within the shell 216 and between the first and second end caps 230, 232. That is, the first and second internal baffles 218, 220 may be disposed within the internal volume 234. The structure and function of the first and second internal baffles 218, 220 may be similar or identical to that of the first and second internal baffles 18, 20 described above.

As described above, the first and second internal baffles 218, 220 may divide the internal volume 234 into a first enclosed chamber 236, a second enclosed chamber 238, and a third enclosed chamber (i.e., an intermediate chamber) 240. The first chamber 236 may be defined by the first internal baffle 218, the first end cap 230 and the shell 216. The second chamber 238 may be defined by the second internal baffle 220, the second end cap 232 and the shell 216. The third chamber 240 is disposed between the first and second chambers 236, 238 and may be defined by the shell 216 and the first and second internal baffles 218, 220. The first and second internal baffles 218, 220 may seal off the third chamber 240 from the first and second chambers 236, 238 such that the first, second and third chambers 236, 238, 240 are only in communication with each other via the internal communication pipe 228.

The first inlet pipe 222 may extend through the shell 216 (or through the second end cap 232) and may extend through the second chamber 238, through the second baffle 220, through the third chamber 240, through the first baffle 218, and into the first chamber 236. The first inlet pipe 222 may include an inlet opening 241 and an outlet opening 243. The inlet opening 241 may be coupled to the first exhaust pipe 212. The outlet opening 243 may be open to and in fluid communication with the first chamber 236.

The second inlet pipe 223 may extend through the shell 216 (or through the first end cap 230) and may extend through the first chamber 236, through the first baffle 218, through the third chamber 240, through the second baffle 220, and into the second chamber 238. The second inlet pipe 223 may include an inlet opening 245 and an outlet opening 247. The inlet opening 245 may be coupled to the second exhaust pipe 213. The outlet opening 247 may be open to and in fluid communication with the second chamber 238.

The first and second inlet pipes 222, 223 may intersect each other and may be in communication with each other at a generally X-shaped (or H-shaped) intersection 225. In this manner, some of the exhaust gas from the first exhaust pipe 212 may flow from the inlet opening 241 of the first inlet pipe 222 to the first chamber 236 via the outlet opening 243 of the first inlet pipe 222, and some of the exhaust gas from the first exhaust pipe 212 may flow from the inlet opening 241 of the first inlet pipe 222 to the second chamber 238 via the outlet opening 247 of the second inlet pipe 223. Similarly, some of the exhaust gas from the second exhaust pipe 213 may flow from the inlet opening 245 of the second inlet pipe 223 to the second chamber 238 via the outlet opening 247 of the second inlet pipe 223, and some of the exhaust gas from the second exhaust pipe 213 may flow from the inlet opening 245 of the second inlet pipe 223 to the first chamber 236 via the outlet opening 243 of the first inlet pipe 222.

The first outlet pipe 224 may be at least partially disposed within the first chamber 236 and may extend through the first end cap 230 (or through the shell 216). The first outlet pipe 224 may include one or more inlet openings 248 and an outlet opening 250. The inlet opening 248 may be in fluid communication with the first chamber 236. The outlet opening 250 is open to the ambient environment surrounding the muffler 210 or the outlet opening 250 could be coupled to another exhaust system component outside of the muffler 210 (e.g., a tailpipe; not shown). In this manner, fluid in the first chamber 236 can exit the muffler 210 by flowing into the inlet opening 248 of the first outlet pipe 224 and through the outlet opening 250 of the first outlet pipe 224. In some configurations, the muffler 210 could include two or more first outlet pipes 224 that are in fluid communication with the first chamber 236 and extend through the first end cap 230 (or shell 216) such that fluid in the first chamber 236 can exit the muffler 210 through the first outlet pipes 224.

The second outlet pipe 226 may be at least partially disposed within the second chamber 238 and may extend through the second end cap 232 (or through the shell 216). The second outlet pipe 226 may include one or more inlet openings 254 and an outlet opening 256. The inlet opening 254 may be in fluid communication with the second chamber 238. The outlet opening 256 is open to the ambient environment surrounding the muffler 210 or the outlet opening 256 could be coupled to another exhaust system component outside of the muffler 210 (e.g., a tailpipe; not shown). In this manner, fluid in the second chamber 238 can exit the muffler 210 by flowing into the inlet opening 254 of the second outlet pipe 226 and through the outlet opening 256 of the second outlet pipe 226. In some configurations, the muffler 210 could include two or more second outlet pipes 226 that are in fluid communication with the second chamber 238 and extend through the second end cap 232 (or shell 216) such that fluid in the second chamber 238 can exit the muffler 210 through the second outlet pipes 226.

The internal communication pipe 228 may extend through the third chamber 240 and through the first and second baffles 218, 220 and into the first and second chambers 236, 238. The internal communication pipe 228 may include a first opening 260, a second opening 262, and a third opening 264. The first opening 260 may be formed in a first axial end 266 of the internal communication pipe 228 that is disposed within the first chamber 236 such that the first opening 260 is in direct fluid communication with the first chamber 236. The second opening 262 may be formed in a second axial end 268 of the internal communication pipe 228 that is disposed within the second chamber 238 such that the second opening 262 is in direct fluid communication with the second chamber 238. The third opening 264 may be formed in an intermediate portion 270 of the internal communication pipe 228 that is disposed between the first and second axial ends 266, 268 and within the third chamber 240 such that the third opening 264 is in direct fluid communication with the third chamber 240. That is, the third opening 264 extends radially through inner and outer diametrical surfaces of the internal communication pipe 228. In this manner, the first and second chambers 236, 238 can communicate with each other and with the third chamber 240 via the internal communication pipe 228.

The internal communication pipe 228 includes only the single third opening 264 in direct fluid communication with the third chamber 240. The lengths and diameters of the pipes 222, 223, 224, 226, 228, volumes of the chambers 236, 238, 240, and the size of the third opening 264 in the internal communication pipe 228, the distances between the first and second openings 260, 262, the distances between the first and third openings 260, 264, and/or the distances between the second and third openings 262, 264 may be tailored to achieve a desired range of sounds and desired performance characteristics over a given range of engine speeds. The single internal communication pipe 228 with the single opening 264 communicating directly with the third chamber 240 provides the desired acoustical characteristics. In some configurations, the third opening 264 may have a diameter that is approximately equal to the inner diameter or the outer diameter of the communication pipe 228. In some configurations, the third opening 264 may have a diameter that is larger or smaller than the inner diameter or the outer diameter of the communication pipe 228. In some configurations, the third opening 264 could be configured as a concentric pipe Helmholtz resonator. In some configurations, the third opening 264 may be an oval or slot with an open area substantially the same as the first and second openings 260, 262. In some configurations, a length that the communication pipe 228 extends into the first and second chambers 236, 238 will allow for acoustic tuning of the muffler 210 without changing the position of the baffles 218, 220. In some configurations, the diameters of the first, second and third openings 260, 262, 264 of the communication pipe 228 may have the same diameters.

While the muffler 210 is described above as receiving exhaust gas from the engine 214 through the inlet pipes 222, 223 and exhaust gas exiting the muffler 210 through the outlet pipes 224, 226, in some configurations, the outlet pipes 224, 226 may be coupled to the exhaust pipes 212, 213 to receive exhaust gas into the muffler 210 and the exhaust gas may exit the muffler 210 through the inlet pipes 222, 223.

In any of the mufflers 10, 110, 210 described above, passive and/or active valves may be added to the communication pipes 64, 164, 264 to adjust the flow of exhaust gas between the chambers 36, 38, 40, 136, 138, 140, 236, 238, 240). In some configurations of the mufflers 10, 110, 210, an additional communication pipe (not shown) may be added that provides fluid communication between the first and second chambers 36, 38, 136, 138, 236, 238. While the chambers 36, 38, 40, 136, 138, 140, 236, 238, 240 are described above as being disposed within a single, common shell 16, 116, 216, in some configurations, the each of the three chambers could be defined by their own separate shells (i.e., satellite mufflers) that are spaced apart from each other and connected to each other by the inlet pipes 22, 122, 123, 222, 223 and the communication pipe 28, 128, 228.

With reference to FIGS. 7-10, another muffler 310 is provided that could replace the muffler 210. That is, the muffler 310 may receive exhaust gas from first and second exhaust pipes 212, 213 connected to the combustion engine 214. The muffler 310 may include a shell 316, a first internal baffle 318, a second internal baffle 320, a first inlet pipe 322, a second inlet pipe 323, a first outlet pipe 324, and a second outlet pipe 326. A first end cap 330 and a second end cap 332 may be fixed to respective axial ends of the shell 316 and may cooperate with the shell 316 to define an internal volume 334. The first and second end caps 330, 332 may be welded, mechanically locked, or otherwise sealingly fixed onto the axial ends of the shell 316. In some configurations, the shell 316 could have a "clamshell" configuration whereby the shell 316 includes two shell halves (or two shell portions) that are welded, mechanically locked, or otherwise sealingly fixed together. In some of such configurations, some or all of each end cap 330, 332 could be integrally formed with or attached to the shell halves (or portions) of the shell 316.

The first and second internal baffles 318, 320 may be disposed within the shell 316 and between the first and second end caps 330, 332. That is, the first and second internal baffles 318, 320 may be disposed within the internal volume 334. The structure and function of the first and second internal baffles 318, 320 may be similar or identical to that of the first and second internal baffles 18, 20 described above.

As described above, the first and second internal baffles 318, 320 may divide the internal volume 334 into a first chamber 336, a second chamber 338, and a third chamber (i.e., an intermediate chamber) 340. The first chamber 336 may be defined by the first internal baffle 318, the first end cap 330 and the shell 316. The second chamber 338 may be defined by the second internal baffle 320, the second end cap 332 and the shell 316. The third chamber 340 is disposed between the first and second chambers 336, 338 and may be defined by the shell 316 and the first and second internal baffles 318, 320. The second internal baffle 320 may seal off the second chamber 338 from the first and third chambers 336, 340 such that the second chamber 338 is only in communication with the first and third chambers 336, 340 via the outlet pipes 324, 326. Apertures 339 may be formed in the first internal baffle 318 to allow communication between the first and third chambers 336, 340.

The first inlet pipe 322 may extend through the first end cap 330 (or through the shell 316) and may extend through the first chamber 336, through the first baffle 318, and into the third chamber 340. The first inlet pipe 322 may include an inlet opening 341 and an outlet opening 343. The inlet opening 341 may be coupled to the first exhaust pipe 212. The outlet opening 343 may be open to and in fluid communication with the third chamber 340. A plurality of apertures 342 may be formed in the first inlet pipe 322 between the inlet and outlet openings 341, 343 (e.g., between the first end cap 330 and the first baffle 318). The apertures 342 extend through outer and inner diametrical surfaces of the first inlet pipe 322 to provide direct communication between the first chamber 336 and the first inlet pipe 322. The apertures 342 may function as resonators.

The second inlet pipe 323 may be a generally J-shaped pipe that may extend through the first end cap 330, through the first chamber 336, through the first baffle 318, through the third chamber 340, through the second baffle 320, into the second chamber 338 where the second inlet pipe 323 bends 180 degrees and extends back through the second baffle 320, and back into the third chamber 340. The second inlet pipe 323 may include an inlet opening 345 and an outlet opening 347. The inlet opening 345 may be coupled to the second exhaust pipe 213. The outlet opening 347 may be open to and in fluid communication with the third chamber 340. A plurality of apertures 346 may be formed in the second inlet pipe 323 between the inlet and outlet openings 341, 343 (e.g., between the first end cap 330 and the first baffle 318). The apertures 346 extend through outer and inner diametrical surfaces of the second inlet pipe 323 to provide direct communication between the first chamber 336 and the second inlet pipe 323. The apertures 346 may function as resonators.

Exhaust gas from the first exhaust pipe 212 may flow from the inlet opening 341 of the first inlet pipe 322 to the third chamber 340 via the outlet opening 343 of the first inlet pipe 322. Exhaust gas from the second exhaust pipe 213 may flow from the inlet opening 345 of the second inlet pipe 323 to the third chamber 340 via the outlet opening 347 of the second inlet pipe 323. Exhaust gases from the first and second inlet pipes 322, 323 may mix inside of the third chamber 340 and inside of the first chamber 336. In this manner, the first and second chambers 336, 340 function as mixing chambers in which exhaust gases from the first and second exhaust pipes 212, 213 may mix. Such mixing inside of the third chamber 340 and inside of the first chamber 336 may smooth-out pressure pulses from the first and second exhaust pipes 212, 213 that are out of phase with each other as they enter the muffler 310. J-shaped second inlet pipe 323 is configured to have a length different than first inlet pipe 322 to more closely synchronize the exhaust pulses. Exhaust pulses will substantially simultaneously enter third chamber 340 in a balanced manner. Outlet openings 343 and 347 may be aligned and oppose one another to further cancel/balance the energy flow.

Figure 8:
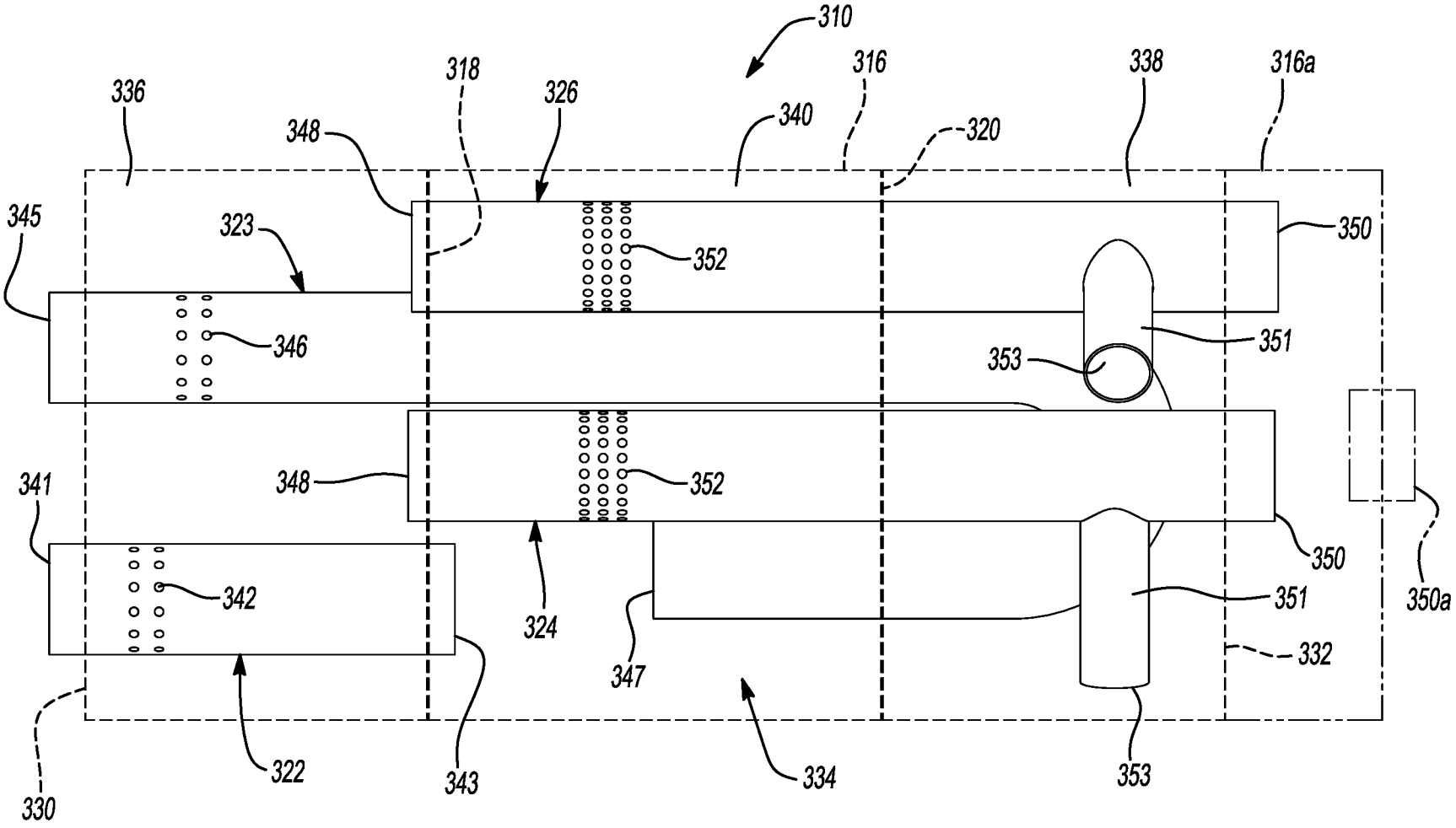
FIG. 8 is a first side view of the muffler of FIG. 7.
Figure 9:
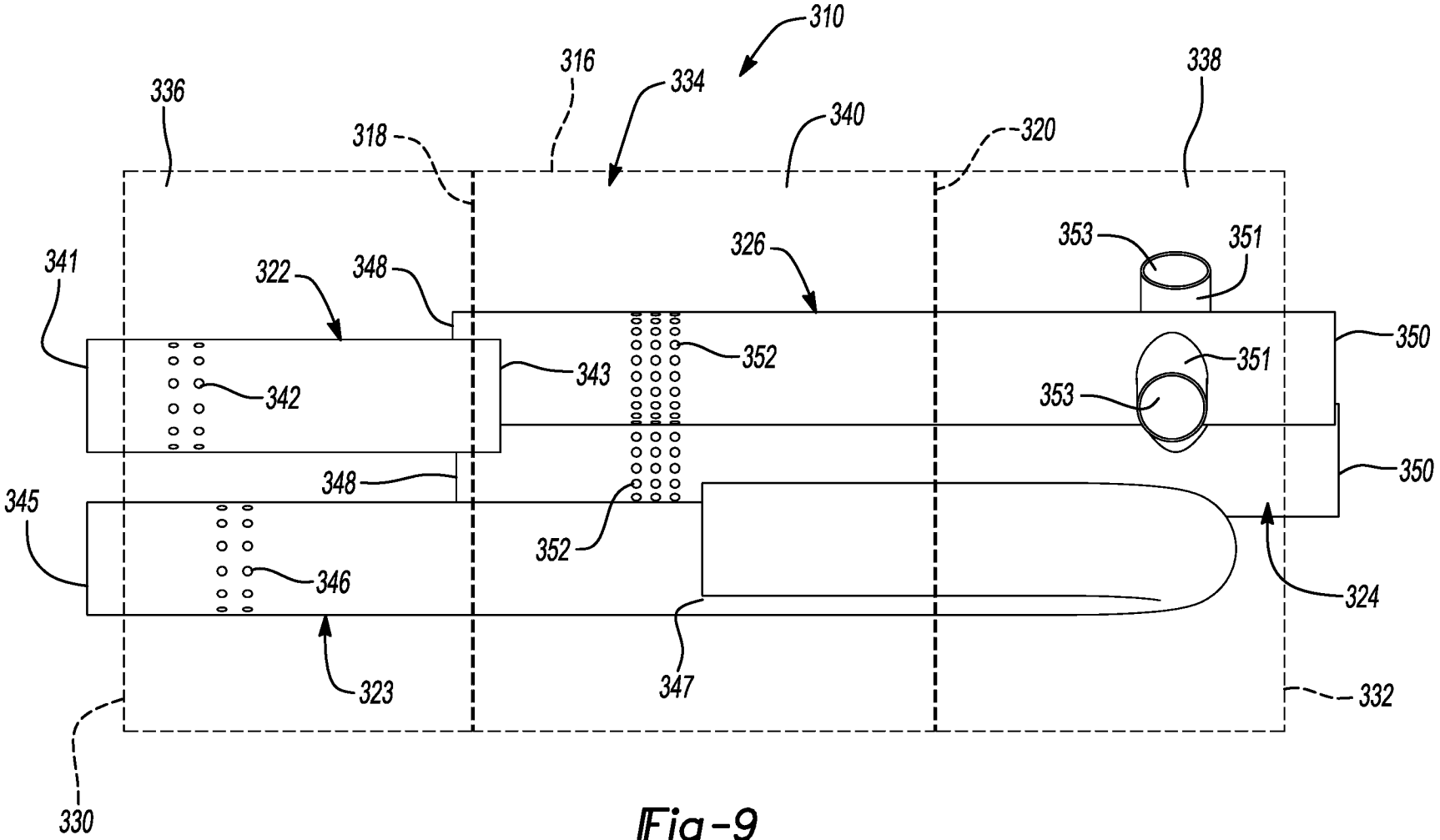
FIG. 9 is a second side view of the muffler of FIG. 7.
Figure 10:
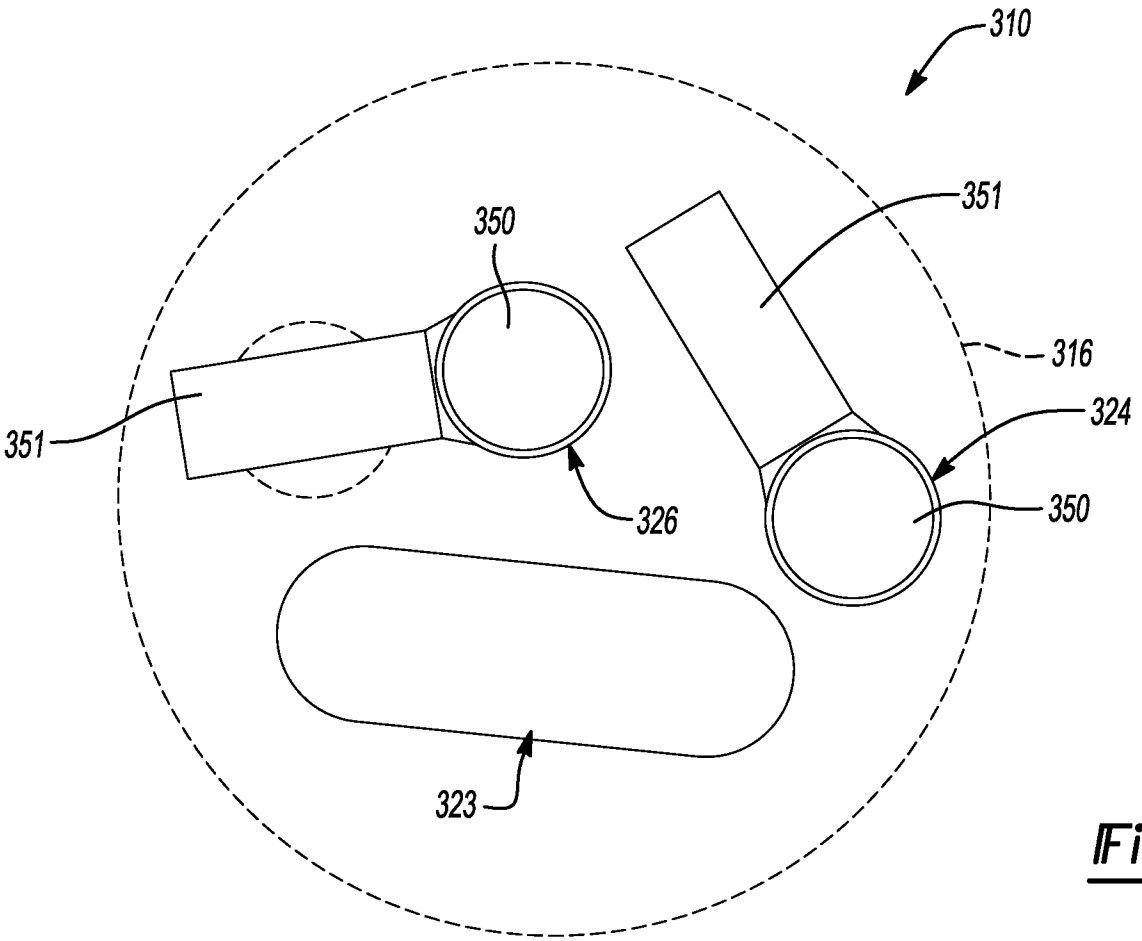
FIG. 10 is an end view of the muffler of FIG. 7.
Figure 11:
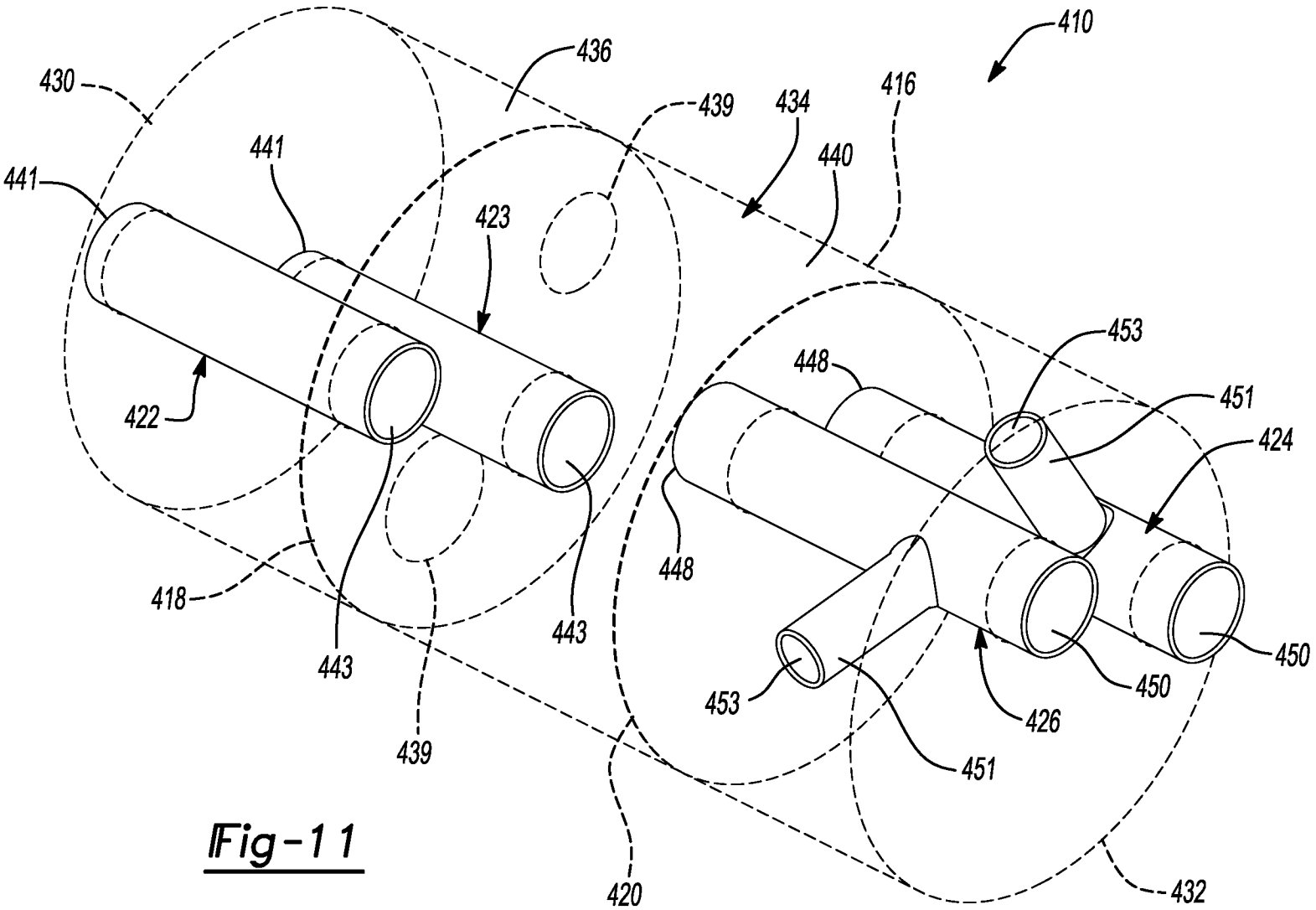
FIG. 11 is a perspective view of another muffler according to the principles of the present disclosure.
Figure 12:
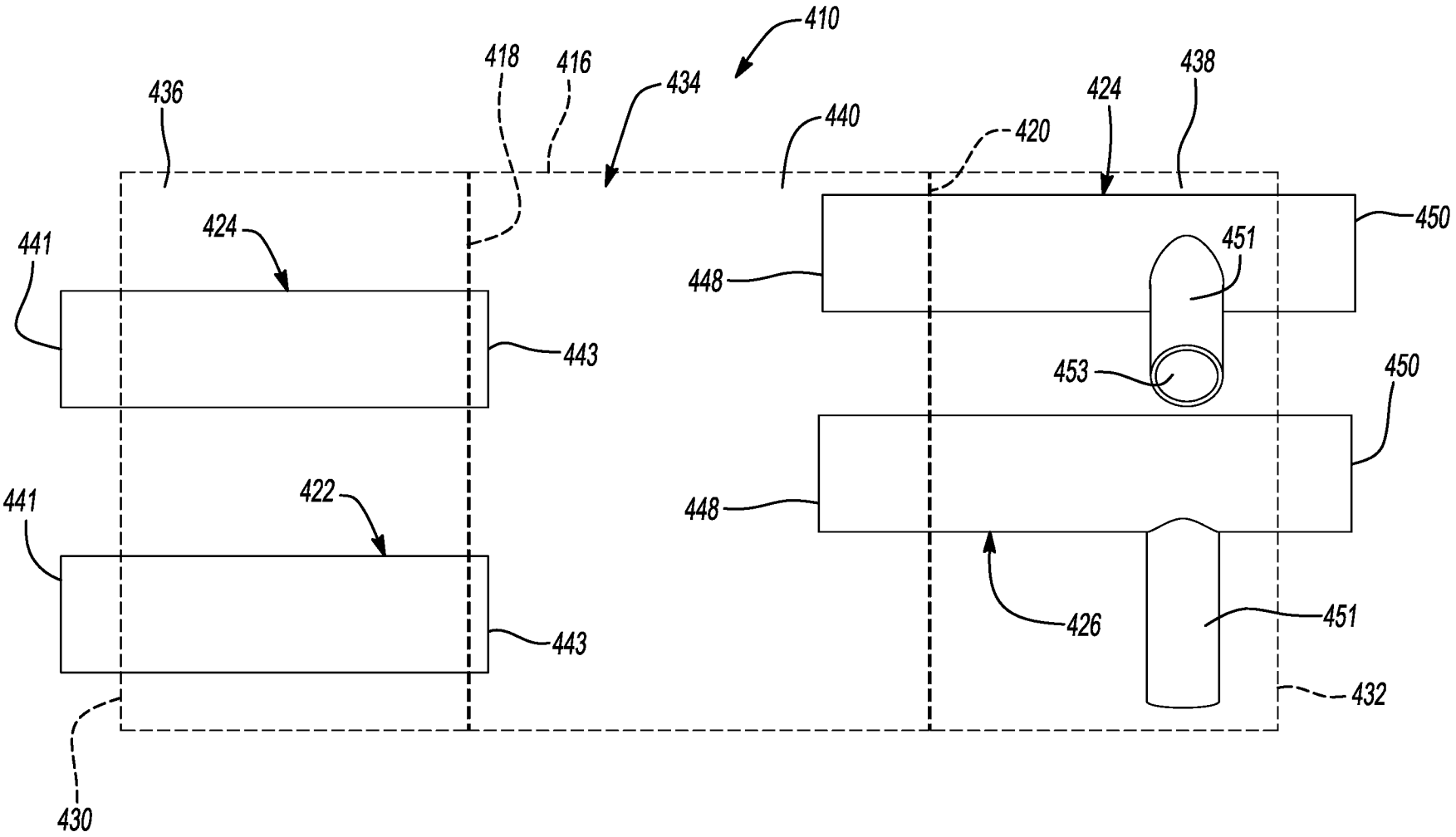
FIG. 12 is a first side view of the muffler of FIG. 11.
Figure 13:
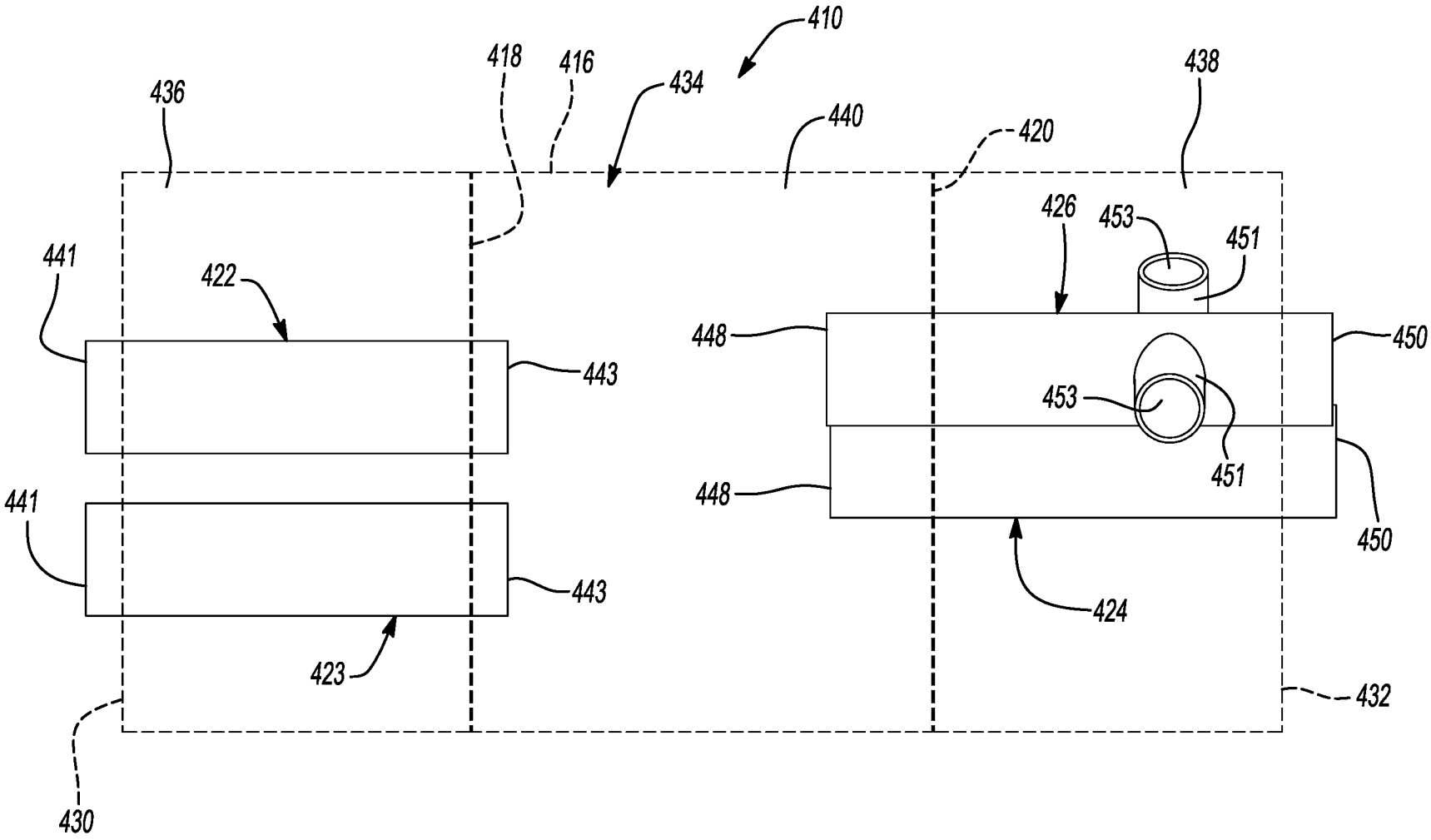
FIG. 13 is a second side view of the muffler of FIG. 11.
Figure 14:
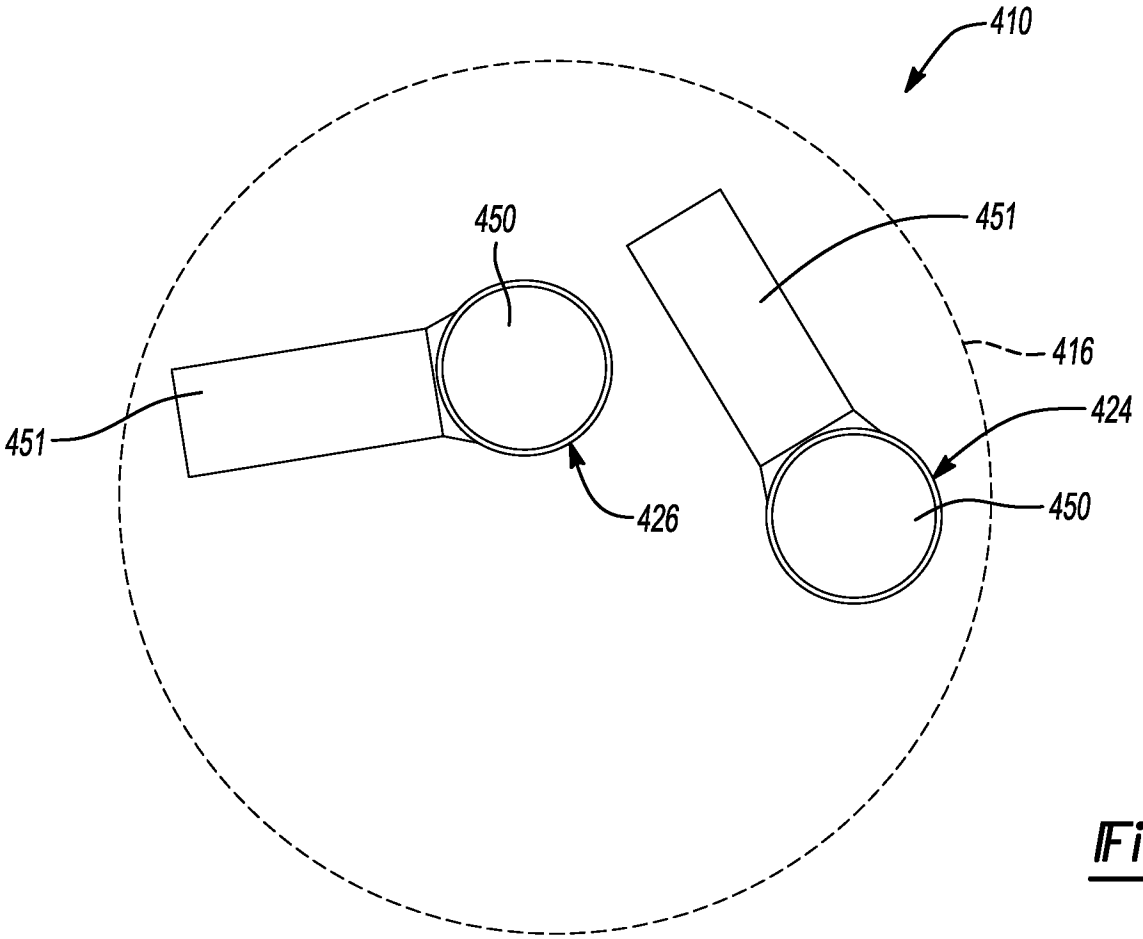
FIG. 14 is an end view of the muffler of FIG. 11.

The first and second outlet pipes 324, 326 may be partially disposed within the first chamber 336 and may extend through the first baffle 318, through the third chamber 340, through the second baffle 320, through the second chamber 338 and through the second end cap 332. The first and second outlet pipes 324, 326 may each include an inlet opening 348, an outlet opening 350, and a Helmholtz neck 351. The inlet openings 348 may be in fluid communication with the first chamber 336. The outlet openings 350 are open to the ambient environment surrounding the muffler 310 or the outlet openings 350 could be coupled to another exhaust system component outside of the muffler 310 (e.g., a tail-pipe; not shown). In this manner, fluid in the first chamber 336 can exit the muffler 310 by flowing into the inlet openings 348 of the first and outlet pipes 324, 326 and through the outlet openings 350 of the first and second outlet pipes 324, 326. Each of the first and second outlet pipes 224 may also include a plurality of apertures 352 between the inlet and outlet openings 348, 350 (e.g., between the first and second baffles 318, 320). The apertures 352 extend through outer and inner diametrical surfaces of the respective first and second outlet pipes 324, 236 to provide direct communication between the third chamber 340 and the first and second outlet pipes 324, 326. The apertures 352 may function as resonators. An alternate arrangement is depicted in FIG. 8 where shell 316 includes a portion 316*a* to capture exhaust exiting first outlet pipe 324 and second outlet pipe 326. A single outlet 350*a* exits shell 316/316*a*. Any of the mufflers described may be configured to include only a single outlet.

Distal ends of the Helmholtz necks 351 have openings 353 in communication with the second chamber 338. As fluid from the first and third chambers 336, 340 flows through the first and second outlet pipes 324, 326, sound waves may travel through the Helmholtz necks 351, through the openings 353, and into the fully enclosed second chamber 338, thereby reducing noise. The Helmholtz necks 351 may both be disposed the same distance between the respective inlet and outlet openings 348, 350 of the respective outlet pipes 324, 326 and may both be disposed the same distance between the second baffle 320 and the second end cap 332. The Helmholtz necks 351 may have the same size (e.g., same axial length and same diameter or width) and the same geometrical shape (e.g., circular or oval cross-sectional shape). Although not explicitly depicted in the Figures, it may be beneficial to orient openings 353 in direct opposition to one another. By facing the openings 353 toward one another, further energy cancellation and noise reduction may occur.

With reference to FIGS. 11-14, another muffler 410 is provided that could replace the muffler 210. That is, the muffler 410 may receive exhaust gas from first and second exhaust pipes 212, 213 connected to the combustion engine 214. The muffler 410 may include a shell 416, a first internal baffle 418, a second internal baffle 420, a first inlet pipe 422, a second inlet pipe 423, a first outlet pipe 424, and a second outlet pipe 426. A first end cap 430 and a second end cap 432 may be fixed to respective axial ends of the shell 416 and may cooperate with the shell 416 to define an internal volume 434. The first and second end caps 430, 432 may be welded, mechanically locked, or otherwise sealingly fixed onto the axial ends of the shell 416. In some configurations, the shell 416 could have a "clamshell" configuration whereby the shell 416 includes two shell halves (or two shell portions) that are welded, mechanically locked, or otherwise sealingly fixed together. In some of such configurations, some or all of each end cap 430, 432 could be integrally formed with or attached to the shell halves (or portions) of the shell 416.

The first and second internal baffles 418, 420 may be disposed within the shell 416 and between the first and second end caps 430, 432. That is, the first and second internal baffles 418, 420 may be disposed within the internal volume 434. The structure and function of the first and second internal baffles 418, 420 may be similar or identical to that of the first and second internal baffles 18, 20, 318, 320 described above. Baffle 420 may include no additional apertures and function differently as described below.

As described above, the first and second internal baffles 418, 420 may divide the internal volume 434 into a first chamber 436, a second chamber 438, and a third chamber (i.e., an intermediate chamber) 440. The first chamber 436 may be defined by the first internal baffle 418, the first end cap 430 and the shell 416. The second chamber 438 may be defined by the second internal baffle 420, the second end cap 432 and the shell 416. The third chamber 440 is disposed between the first and second chambers 436, 438 and may be defined by the shell 416 and the first and second internal baffles 418, 420. The second internal baffle 420 may seal off the second chamber 438 from the first and third chambers 436, 440 such that the second chamber 438 is only in communication with the first and third chambers 436, 440 via the outlet pipes 424, 426. Apertures 439 may be formed in the first internal baffle 418 to allow communication between the first and third chambers 436, 440. No such apertures are formed in second internal baffle 420. As such, second internal baffle 420 at least partially defines a dead chamber 438.

The first and second inlet pipes 422, 423 may extend through the first end cap 430 (or through the shell 416) and may extend through the first chamber 436, through the first baffle 418, and into the third chamber 440. The first and second inlet pipes 422 may each include an inlet opening 441 and an outlet opening 443. The inlet opening 441 of the first inlet pipe 422 may be coupled to the first exhaust pipe 212. The inlet opening 441 of the second inlet pipe 423 may be coupled to the second exhaust pipe 213. The outlet openings 443 of the first and second inlet pipes 422, 423 may be open to and in fluid communication with the third chamber 440. In some configurations, a plurality of resonator apertures (not shown; similar or identical to apertures 342 described above) may be formed in the inlet pipes 422, 423 between the inlet and outlet openings 441, 443 (e.g., between the first end cap 430 and the first baffle 418).

Exhaust gas from the first exhaust pipe 212 may flow from the inlet opening 441 of the first inlet pipe 422 to the third chamber 440 via the outlet opening 443 of the first inlet pipe 422. Exhaust gas from the second exhaust pipe 213 may flow from the inlet opening 441 of the second inlet pipe 423 to the third chamber 440 via the outlet opening 443 of the second inlet pipe 423. Exhaust gases from the first and second inlet pipes 422, 423 may mix inside of the third chamber 440 and inside of the first chamber 436. In this manner, the first and second chambers 436, 440 function as mixing chambers in which exhaust gases from the first and second exhaust pipes 212, 213 may mix. Such mixing inside of the third chamber 440 and inside of the first chamber 436 may smooth-out pressure pulses from the first and second exhaust pipes 212, 213 that are out of phase with each other as they enter the muffler 410.

The first and second outlet pipes 424, 426 may be partially disposed within the third chamber 436 and may extend through the second baffle 420, through the second chamber 438 and through the second end cap 432. The first and second outlet pipes 424, 426 may each include an inlet opening 448, an outlet opening 450, and a Helmholtz neck 451. The inlet openings 448 may be in fluid communication with the third chamber 440. The outlet openings 450 are open to the ambient environment surrounding the muffler 410 or the outlet openings 450 could be coupled to another exhaust system component outside of the muffler 410 (e.g., a tailpipe; not shown). In this manner, fluid in the third chamber 440 can exit the muffler 410 by flowing into the inlet openings 448 of the first and second outlet pipes 424, 426 and through the outlet openings 450 of the first and second outlet pipes 424, 426. Each of the first and second outlet pipes 424, 426 may also include a plurality of resonator apertures (not shown, similar or identical to apertures 352 described above) between the inlet and outlet openings 448, 450.

Distal ends of the Helmholtz necks 451 have openings 453 in communication with and open to the second chamber 438. As fluid from the third chamber 440 flows through the first and second outlet pipes 424, 426, sound waves may travel through the Helmholtz necks 451, through the openings 453, and into the fully enclosed second chamber 438, thereby reducing noise. The Helmholtz necks 451 may both be disposed the same distance between the respective inlet and outlet openings 448, 450 of the respective outlet pipes 424, 426 and may both be disposed the same distance between the second baffle 420 and the second end cap 432. The Helmholtz necks 451 may have the same size (e.g., same axial length and same diameter or width) and the same geometrical shape (e.g., circular or oval cross-sectional shape).

Figure 15:
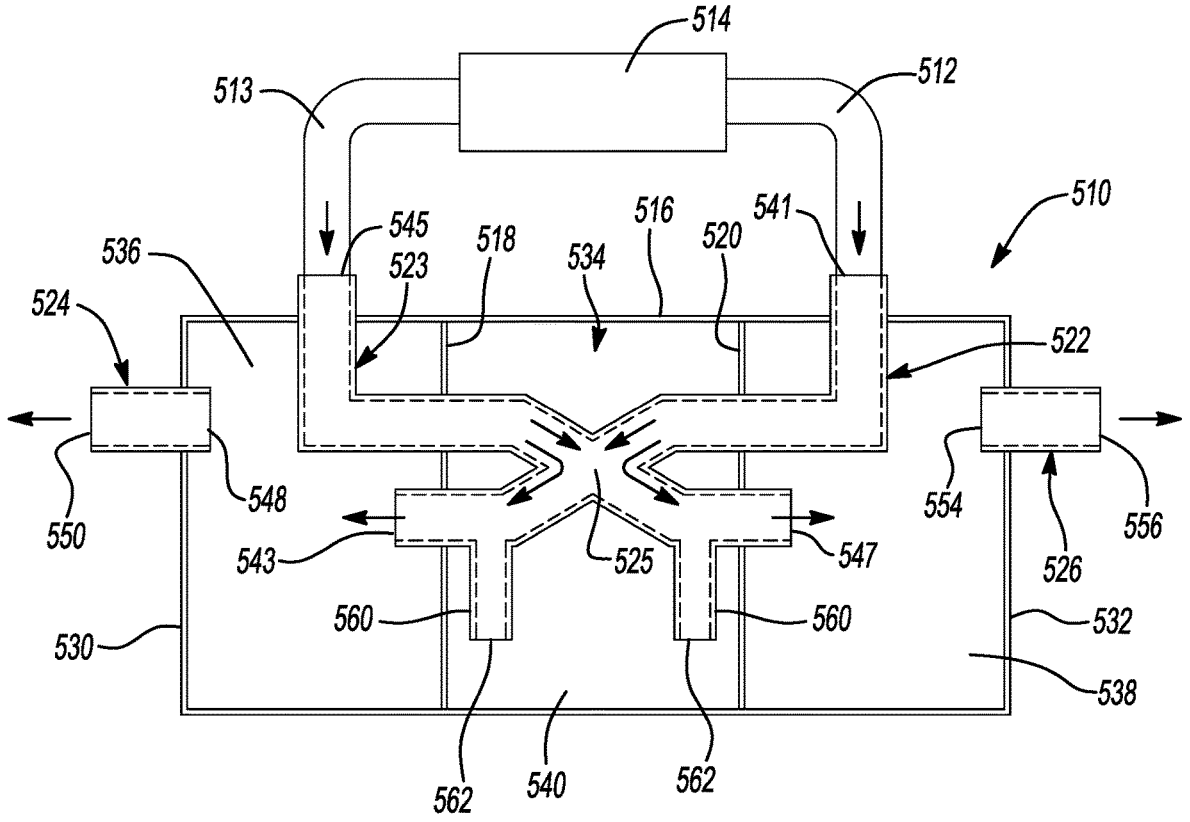
FIG. 15 is a schematic representation of yet another engine and exhaust system having yet another muffler according to the principles of the present disclosure.

With reference to FIG. 15, another muffler 510 is provided that may receive exhaust gas from first and second exhaust pipes 512, 513 connected to a combustion engine 514. The muffler 510 may include a shell 516, a first internal baffle 518, a second internal baffle 520, a first inlet pipe 522, a second inlet pipe 523, a first outlet pipe 524, and a second outlet pipe 526. A first end cap 530 and a second end cap 532 may be fixed to respective axial ends of the shell 516 and may cooperate with the shell 516 to define an internal volume 534. The first and second end caps 530, 532 may be welded, mechanically locked, or otherwise sealingly fixed onto the axial ends of the shell 516. In some configurations, the shell 516 could have a "clamshell" configuration whereby the shell 516 includes two shell halves (or two shell portions) that are welded, mechanically locked, or otherwise sealingly fixed together. In some of such configurations, some or all of each end cap 530, 532 could be integrally formed with or attached to the shell halves (or portions) of the shell 516.

The first and second internal baffles 518, 520 may be disposed within the shell 516 and between the first and second end caps 530, 532. That is, the first and second internal baffles 518, 520 may be disposed within the internal volume 534. The structure and function of the first and second internal baffles 518, 520 may be similar or identical to that of the first and second internal baffles 18, 20 described above.

As described above, the first and second internal baffles 518, 520 may divide the internal volume 534 into a first enclosed chamber 536, a second enclosed chamber 538, and a third enclosed chamber (i.e., an intermediate chamber) 540. The first chamber 536 may be defined by the first internal baffle 518, the first end cap 530 and the shell 516. The second chamber 538 may be defined by the second internal baffle 520, the second end cap 532 and the shell 516. The third chamber 540 is disposed between the first and second chambers 536, 538 and may be defined by the shell 516 and the first and second internal baffles 518, 520. The first and second internal baffles 518, 520 may seal off the third chamber 540 from the first and second chambers 536, 538.

The first inlet pipe 522 may extend through the shell 516 (or through the second end cap 532) and may extend through the second chamber 538, through the second baffle 520, through the third chamber 540, through the first baffle 518, and into the first chamber 536. The first inlet pipe 522 may include an inlet opening 541 and an outlet opening 543. The inlet opening 541 may be coupled to the first exhaust pipe 512. The outlet opening 543 may be open to and in fluid communication with the first chamber 536.

The second inlet pipe 523 may extend through the shell 516 (or through the first end cap 530) and may extend through the first chamber 536, through the first baffle 518, through the third chamber 540, through the second baffle 520, and into the second chamber 538. The second inlet pipe 523 may include an inlet opening 545 and an outlet opening 547. The inlet opening 545 may be coupled to the second exhaust pipe 513. The outlet opening 547 may be open to and in fluid communication with the second chamber 538.

The first and second inlet pipes 522, 523 may intersect each other and may be in communication with each other at a generally X-shaped (or H-shaped) intersection 525. In this manner, some of the exhaust gas from the first exhaust pipe 512 may flow from the inlet opening 541 of the first inlet pipe 522 to the first chamber 536 via the outlet opening 543 of the first inlet pipe 522, and some of the exhaust gas from the first exhaust pipe 512 may flow from the inlet opening 541 of the first inlet pipe 522 to the second chamber 538 via the outlet opening 547 of the second inlet pipe 523. Similarly, some of the exhaust gas from the second exhaust pipe 513 may flow from the inlet opening 545 of the second inlet pipe 523 to the second chamber 538 via the outlet opening 547 of the second inlet pipe 523, and some of the exhaust gas from the second exhaust pipe 513 may flow from the inlet opening 545 of the second inlet pipe 523 to the first chamber 536 via the outlet opening 543 of the first inlet pipe 522.

The intersection 525 is a mixing chamber in which exhaust gases from the first and second exhaust pipes 512, 513 may mix. Such mixing inside of the intersection 525 may smooth-out pressure pulses from the first and second exhaust pipes 512, 513 that are out of phase with each other as they enter the muffler 510.

Each of the inlet pipes 522, 523 may include a Helmholtz neck 560 disposed downstream of the intersection 525. Distal ends of the Helmholtz necks 560 include openings 562 that are in communication with an open to the third chamber 540. As fluid from the intersection 545 flows towards the outlet openings 543, 547 of the inlet pipes 522, 523, sound waves may travel through the Helmholtz necks 560, through the openings 562, and into the fully enclosed third chamber 540, thereby reducing noise. The Helmholtz necks 560 may both be disposed the same distance from the respective outlet openings 543, 547. The Helmholtz necks 560 may have the same size (e.g., same axial length and same diameter or width) and the same geometrical shape (e.g., circular or oval cross-sectional shape).

The first outlet pipe 524 may be at least partially disposed within the first chamber 536 and may extend through the first end cap 530 (or through the shell 516). The first outlet pipe 524 may include one or more inlet openings 548 and an outlet opening 550. The inlet opening 548 may be in fluid communication with the first chamber 536. The outlet opening 550 is open to the ambient environment surrounding the muffler 510 or the outlet opening 550 could be coupled to another exhaust system component outside of the muffler 510 (e.g., a tailpipe; not shown). In this manner, fluid in the first chamber 536 can exit the muffler 510 by flowing into the inlet opening 548 of the first outlet pipe 524 and through the outlet opening 550 of the first outlet pipe 524. In some configurations, the muffler 510 could include two or more first outlet pipes 524 that are in fluid communication with the first chamber 536 and extend through the first end cap 530 (or shell 516) such that fluid in the first chamber 536 can exit the muffler 510 through the first outlet pipes 524.

The second outlet pipe 526 may be at least partially disposed within the second chamber 538 and may extend through the second end cap 532 (or through the shell 516). The second outlet pipe 526 may include one or more inlet openings 554 and an outlet opening 556. The inlet opening 554 may be in fluid communication with the second chamber 538. The outlet opening 556 is open to the ambient environment surrounding the muffler 510 or the outlet opening 556 could be coupled to another exhaust system component outside of the muffler 510 (e.g., a tailpipe; not shown). In this manner, fluid in the second chamber 538 can exit the muffler 510 by flowing into the inlet opening 554 of the second outlet pipe 526 and through the outlet opening 556 of the second outlet pipe 526. In some configurations, the muffler 510 could include two or more second outlet pipes 526 that are in fluid communication with the second chamber 538 and extend through the second end cap 532 (or shell 516) such that fluid in the second chamber 538 can exit the muffler 510 through the second outlet pipes 526.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A muffler for receiving exhaust gas from a combustion engine, the muffler comprising:

a shell;

a baffle disposed within the shell and cooperating with the shell to define a first chamber and a second chamber;

an inlet pipe extending through the shell and providing exhaust gas to the first chamber; and a pair of outlet pipes in communication with the first chamber, the outlet pipes extending through the shell and including openings through which exhaust gas exits the muffler, each of the outlet pipes including a Helmholtz neck that is open to the second chamber.

2. The muffler of claim 1, wherein the second chamber is a dead chamber that is in fluid communication with the first chamber only via the Helmholtz necks.

3. The muffler of claim 1, further including another baffle disposed within the shell, the another baffle being positioned in the first chamber defining first and second cavities on opposite sides of the another baffle, at least one aperture extends through the another baffle placing the first and second cavities in fluid communication with one another, the inlet pipe extending through the another baffle.

4. The muffler of claim 3, wherein the inlet pipe is contiguous and enclosed for its entire extent within the first cavity.

5. The muffler of claim 4, wherein the inlet pipe includes an outlet positioned within the second cavity.

6. The muffler of claim 5, wherein each of the outlet pipes includes an inlet within the second cavity.

7. The muffler of claim 6, wherein the outlet of the inlet pipe is not coaxially aligned with either of the inlets of the outlet pipes.

8. The muffler of claim 1, wherein each of the outlet pipes includes an inlet, each of the Helmholtz necks being spaced apart from the respective outlet pipe inlet the same distance as the other.

9. The muffler of claim 1, further including another inlet pipe extending through the shell and providing exhaust gas to the first chamber.

10. The muffler of claim 9, wherein the inlet pipe and the another inlet pipe each include outlets that are not aligned with an inlet of either outlet pipe.

11. The muffler of claim 9, wherein the inlet pipe and the another inlet pipe each extend parallel to the outlet pipes.

* * * * *